US008501379B2

(12) United States Patent
Sugimoto et al.

(10) Patent No.: US 8,501,379 B2
(45) Date of Patent: Aug. 6, 2013

(54) TONER AND METHOD FOR PRODUCING THE SAME AND DEVELOPER

(75) Inventors: Tsuyoshi Sugimoto, Mishima (JP); Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 827 days.

(21) Appl. No.: 12/135,474

(22) Filed: Jun. 9, 2008

(65) Prior Publication Data

US 2008/0318148 A1 Dec. 25, 2008

(30) Foreign Application Priority Data

Jun. 19, 2007 (JP) ..... 2007-161788

(51) Int. Cl.
*G03G 9/08* (2006.01)

(52) U.S. Cl.
USPC ..... 430/108.4; 430/109.4; 430/137.1; 430/137.14

(58) Field of Classification Search
USPC ..... 430/108.4, 109.4, 137.1, 137.14
See application file for complete search history.

(56) References Cited

U.S. PATENT DOCUMENTS

| | | | | |
|---|---|---|---|---|
| 5,466,555 | A | 11/1995 | Taguchi et al. | |
| 5,853,940 | A * | 12/1998 | Kido et al. | 430/108.4 |
| 6,159,647 | A | 12/2000 | Anno et al. | |
| 6,492,083 | B1 * | 12/2002 | Livengood et al. | 430/108.4 |
| 7,645,550 | B2 * | 1/2010 | Yuasa et al. | 430/108.4 |
| 2002/0028402 | A1 | 3/2002 | Matsuoka et al. | |
| 2002/0098434 | A1 | 7/2002 | Anno et al. | |
| 2003/0235772 | A1 | 12/2003 | Ogawa et al. | |
| 2006/0063089 | A1 | 3/2006 | Tanaka et al. | |
| 2006/0210902 | A1 | 9/2006 | Nakamura et al. | |

FOREIGN PATENT DOCUMENTS

| | | |
|---|---|---|
| JP | 52-3304 | 1/1977 |
| JP | 52-3305 | 1/1977 |
| JP | 54-30287 | 3/1979 |
| JP | 1-185660 | 7/1989 |
| JP | 1-185661 | 7/1989 |
| JP | 1-185662 | 7/1989 |
| JP | 1-185663 | 7/1989 |
| JP | 2-82267 | 3/1990 |
| JP | 3-50560 | 3/1991 |
| JP | 3-199267 | 8/1991 |
| JP | 3-229262 | 10/1991 |
| JP | 7-281478 | 10/1995 |
| JP | 2537503 | 9/1996 |
| JP | 11-44969 | 2/1999 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 187 & 188.*

(Continued)

*Primary Examiner* — Christopher Rodee
(74) *Attorney, Agent, or Firm* — Oblon, Spivak, McClelland, Maier & Neustadt, L.L.P.

(57) ABSTRACT

A toner containing base particles produced by dissolving and/or dispersing a toner material in an organic solvent so as to prepare a toner material solution, and emulsifying and/or dispersing the toner material solution in an aqueous medium, wherein the toner material contains a binder resin and a releasing agent, the binder resin contains a polyester resin, and the releasing agent is a hydrocarbon wax which is modified with a carboxylic acid or carboxylic anhydride.

15 Claims, 4 Drawing Sheets

(56) References Cited

FOREIGN PATENT DOCUMENTS

| | | |
|---|---|---|
| JP | 11-65172 | 3/1999 |
| JP | 11-149180 | 6/1999 |
| JP | 11-305486 | 11/1999 |
| JP | 2000-10338 | 1/2000 |
| JP | 2001-13726 | 1/2001 |
| JP | 2004-29160 | 1/2004 |
| JP | 3596104 | 9/2004 |
| JP | 2574209 | 12/2004 |
| JP | 2005-122073 | 5/2005 |
| JP | 2006-85095 | 3/2006 |
| JP | 3762079 | 3/2006 |
| JP | 2006-162607 | 6/2006 |
| JP | 2006-293309 | 10/2006 |
| JP | 2006-293317 | 10/2006 |
| JP | 2007-100010 | 4/2007 |
| JP | 2009-66984 | 4/2009 |

OTHER PUBLICATIONS

Borsenberger, Paul M. et al. Organic Photoreceptors for Imaging Systems. New York: Marcel-Dekker, Inc. (1993) pp. 6-17.*

Information Offer Form issued Jul. 28, 2010 in JP Application No. 2007-161788 (With English Translation).

Office Action issued Mar. 21, 2012, in Japanese Patent Application No. 2007-161788.

Japanese Information Offer Form issued Jun. 30, 2010, in Patent Application No. 2007-161788 (with English-language translation).

* cited by examiner

TONER AND METHOD FOR PRODUCING THE SAME AND DEVELOPER

BACKGROUND OF THE INVENTION

1. Field of the Invention

The present invention relates to a toner, a method for producing the toner and a developer.

2. Description of the Related Art

Conventionally, in electrophotographic apparatuses and electrostatic recording apparatuses, electric latent images or magnetic latent images are made to visible images by using a toner. For example, in electrophotography, a latent electrostatic image (latent image) is formed on a photoconductor, and the latent image is developed using a toner so as to form a toner image (visible image). The toner image is generally transferred to a recording medium such as a paper, and then fixed, for example, by heating. The toner particles used for a latent electrostatic development are generally colored particles in which a colorant, charge controlling agent, and other additives are contained in a binder resin.

For a fixing method based on the dry development, an image fixed by using a heating roller is generally used for favorable energy efficiency. Moreover, in recent years, for saving energy by fixing a toner at low-temperature, there is a tendency that the heat energy required to be given to the toner at the time of fixing is low. In DSM (demand-side management) programs of the International Energy Agency (IEA) in 1999, there is a project for procuring technologies of the next generation copiers, and requirement specifications thereof have been disclosed. For a copier of 30 cpm (copies per minute) or more, save of a significant amount of energy as compared to the conventional copiers is required to be accomplished such that the stand-by time is 10 seconds or less, and power consumption during the stand-by time is 10 watts to 30 watts (varies depending on a copying speed). One of the methods for achieving the requirement is a method of improving a temperature response of toner by lowering heat capacity of a fixing member such as the heating roller etc. However, this method does not sufficiently satisfy the requirement.

To satisfy the requirement and minimize the stand-by time, it is considered that an essential technical requirement is that the melt starting temperature of toner is lowered so as to lower the toner-fixing temperature when the machine is in use. In order to deal with such low-temperature fixing, attempts have been made to use a polyester resin having an excellent low-temperature fixing property and comparatively favorable heat resistance and storage stability, instead of a styrene-acrylic resin which has been conventionally used.

As for the fixing system in the electrophotography, a heat roller fixing system is widely used for its high energy efficiency and in view of device miniaturization, in which system a heating roller which is excellent in heat efficiency is directly pressed against a toner image on a recording medium for fixing. Considering the environment-friendly policy including energy-saving, lower power consumption is desired for the heating roller in the fixing step.

In attempts to solve the above problem, fixing units have been improved and rollers have a reduced thickness on the side in contact with the toner image carrying surface for further increasing heat energy efficiency, realizing a significant reduction in start-up time. However, the reduced specific heat capacity has caused a difference in temperature between the area where the recording medium passes through and the area where the recording medium does not. Then, a so-called hot offset phenomenon occurs in which toner melts and adheres to a fixing roller and, after one rotation of the fixing roller, this toner is fixed to non-image areas on the recording medium. Therefore, there is a severe demand for toner on hot offset resistance as well as low-temperature fixing property.

Methods for producing a toner for developing a latent electrostatic image are broadly classified into pulverization methods and polymerization methods. In the pulverization method, a colorant, charge controlling agent, anti-offset agent, and the like are melted, mixed and uniformly dispersed in a thermoplastic resin to obtain a toner composition, and then the composition is pulverized and classified to thereby produce a toner. According to the pulverization method, it is possible to produce a toner having excellent properties to some extent, however, there are limitations on selection of toner materials. For example, a toner composition produced by melting and mixing toner materials are required to be pulverized and classified by using an economically available apparatus. To respond to the request, the melted and mixed toner component is forced to be made sufficiently brittle. For this reason, when the toner composition is pulverized into particles, a particle size distribution is liable to be broad. When a copied image having excellent resolution and gradation is expected to be obtained, for example, it suffers from the disadvantages that fine particles each having a particle diameter of 4 μm or less and particles each having a particle diameter of 15 μm or more must be eliminated by classifying the toner particles, thereby causing substantially low toner yield. In addition, in the pulverization method, it is hard to uniformly disperse a colorant and charge controlling agent, and the like in a thermoplastic resin. A dispersion solution in which components are insufficiently dispersed adversely affects flowability, developing property and durability of a toner, image quality, and the like.

Recently, in order to overcome the problems in the pulverization method, a toner production method by means of a polymerization method has been proposed. For example, a toner is produced by a suspension polymerization method, emulsion polymerization aggregation method and the like. However, it is difficult to produce a toner using a polyester resin which is excellent in low-temperature fixing property.

To solve these problems, it is known a dry toner consisting of particles formed by the elongation reaction and/or crosslinking reaction of an isocyanate group-containing prepolymer (A) with amines (B) in an aqueous medium (JP-A No. 11-149180). Such a toner is relatively excellent in low-temperature fixing property by using a polyester resin as a binder resin. However, the requirement to hot offset resistance is not satisfied only by containing high molecular mass component in the binder resin and it is necessary to contain a releasing agent in a toner.

In attempting to improve hot offset resistance, the releasing agent preferably has low melt viscosity and excellent separation property from a resin. Examples of generally known releasing agents used in a toner are, for example, carnauba wax, montan wax (Japanese Patent Application Laid-Open (JP-A) Nos. 1-185660, 1-185661, 1-185662 and 1-185663), hydrocarbon wax such as polyethylenes, polypropylenes and paraffins (Japanese Patent Application Publication (JP-B) Nos. 52-3304 and 52-3305). Of these, hydrocarbon wax is significantly effective to improve hot offset resistance because it has polarity largely different from a polyester resin, excellent separation property between an image and a fixing member and low melt viscosity, and quickly exudes from a toner to the fixing member.

On the other hand, in a toner obtained by emulsifying or dispersing a solution containing a material constituting the toner (toner material solution) in an aqueous medium, it has revealed that the most frequent volume particle diameter of a dispersoid of the toner material solution influences uniformity in compositions and particle diameters of base particles to be obtained (see JP-A 2006-293309). At the same time, the releasing agent contained in the toner material solution significantly influences uniformity of base particles. Uneven compositions and particle diameters of the base particles cause wide variation of charging ability, flowability and fixing property of the toner, and easily cause fog image by uncharged toner, toner scattering to a non-image part, occurrence of background smear, adhesion of a toner constituent to a developing part, and offset to a fixing member. Thus, a stable and high quality image is hard to be obtained. Therefore, the releasing agent is desired to be finely dispersed.

However, it is very difficult to finely disperse the hydrocarbon wax in the toner material solution, because the polarity of the hydrocarbon wax is largely different from those of an organic solvent and a polyester resin, and a functional group having compatibility is not present between the hydrocarbon wax and the polyester resin. Moreover, a great amount of energy is needed to improve dispersibility, because a dispersion step takes an extremely long time. Additionally, production of a toner having a constant quality for a long period is difficult because the releasing agent easily aggregates over time in the toner material solution.

Moreover, an organic solvent having relatively high polarity and low boiling point is frequently used, because it has high solubility to polyester resins and can be easily removed. Of these, as a main component, ester solvents such as ethyl acetate and ketone solvents such as methyl ethyl ketone are frequently used. However, when such an organic solvent is used, compatibility between the organic solvent and the hydrocarbon wax tends to be further decreased, thus it becomes more difficult to finely disperse the hydrocarbon wax in the toner material solution.

BRIEF SUMMARY OF THE INVENTION

The present invention has been made in view of the problems in the conventional technologies described above, and is aimed to provide a toner having excellent low-temperature fixing property and offset resistance and capable of forming high quality image for a long period and a method for producing the toner, and a developer containing the toner.

<1> A toner containing base particles produced by dissolving and/or dispersing a toner material in an organic solvent so as to prepare a toner material solution, and emulsifying and/or dispersing the toner material solution in an aqueous medium, wherein the toner material contains a binder resin and a releasing agent, the binder resin contains a polyester resin, and the releasing agent is a hydrocarbon wax which is modified with a carboxylic acid or carboxylic anhydride.

<2> The toner according to <1>, wherein the releasing agent has an acid value of 1 mg KOH/g to 100 mg KOH/g.

<3> The toner according to <1>, wherein the releasing agent has an acid value of 3 mg KOH/g to 20 mg KOH/g.

<4> The toner according to any one of <1> to <3>, wherein the polyester resin has an acid value of 5 mg KOH/g to 40 mg KOH/g.

<5> The toner according to any one of <1> to <4>, wherein the releasing agent is a paraffin wax modified with a carboxylic acid or carboxylic anhydride.

<6> The toner according to any one of <1> to <5>, wherein the carboxylic anhydride is maleic anhydride.

<7> The toner according to any one of <1> to <6>, wherein the releasing agent has a melting point of 50° C. to 90° C.

<8> The toner according to any one of <1> to <7>, wherein the releasing agent has a melt viscosity at 120° C. of 1.0 mPa·s to 20 mPa·s.

<9> The toner according to any one of <1> to <8>, wherein the releasing agent has a dispersion diameter of 0.05 μm to 1.0 μm in the base particles.

<10> The toner according to any one of <1> to <9>, wherein the base particles have a volume average particle diameter of 3.0 μm to less than 6.0 μm.

<11> The toner according to any one of <1> to <10>, wherein the base particles have a ratio of the volume average particle diameter to a number average particle diameter of 1.00 to 1.15.

<12> The toner according to any one of <1> to <11>, wherein the mass ratio of the releasing agent relative to the base particles is 1% to 20%.

<13> The toner according to any one of <1> to <12>, wherein the binder resin further contains a polyester resin having a functional group reactive with an active hydrogen group, and wherein the polyester resin having a functional group reactive with an active hydrogen group and an active hydrogen group-containing compound are reacted in the aqueous medium.

<14> A method for producing the toner according to any one of <1> to <13>, including dissolving and/or dispersing the toner material in the organic solvent so as to prepare the toner material solution, and emulsifying and/or dispersing the toner material solution in the aqueous medium so as to prepare the base particles.

<15> The method for producing the toner according to <14>, wherein the organic solvent has a solubility parameter of 8 $cal^{1/2}\cdot m^{-3/2}$ to 9.8 $cal^{1/2}\cdot m^{-3/2}$.

<16> The method for producing the toner according to any one of <14> to <15>, wherein the step of dissolving and/or dispersing the toner material in the organic solvent so as to prepare the toner material solution includes heating and dissolving the binder resin and the releasing agent in the organic solvent so as to prepare a solution in which the binder resin and the releasing agent are dissolved, and cooling the solution.

<17> A developer containing the toner according to any one of <1> to <13>.

<18> The developer according to <17>, further containing a carrier.

<19> A developer container containing the developer according to any one of <17> to <18>.

<20> An image forming method including forming a latent electrostatic image on a latent electrostatic image bearing member, and developing the latent electrostatic image formed on the latent electrostatic image bearing member using the developer according to any one of <17> to <18>.

<21> An image forming apparatus including a latent electrostatic image bearing member on which a latent electrostatic image is formed, and a developing unit configured to develop the latent electrostatic image formed on the latent electrostatic image bearing member using the developer according to any one of <17> to <18>.

<22> A process cartridge containing a latent electrostatic image bearing member on which a latent electrostatic image is formed, and a developing unit configured to develop the latent electrostatic image formed on the latent electrostatic image bearing member using the developer according to any one of <17> to <18>, wherein the latent electrostatic image bearing member and the developing unit are integrated, and the process cartridge is detachably mounted on an image forming apparatus.

According to the present invention, a toner having excellent low-temperature fixing property and offset resistance and capable of forming high quality image for a long period, a method for producing the toner, and a developer containing the toner can be provided.

DETAILED DESCRIPTION OF THE INVENTION

Figure 1:
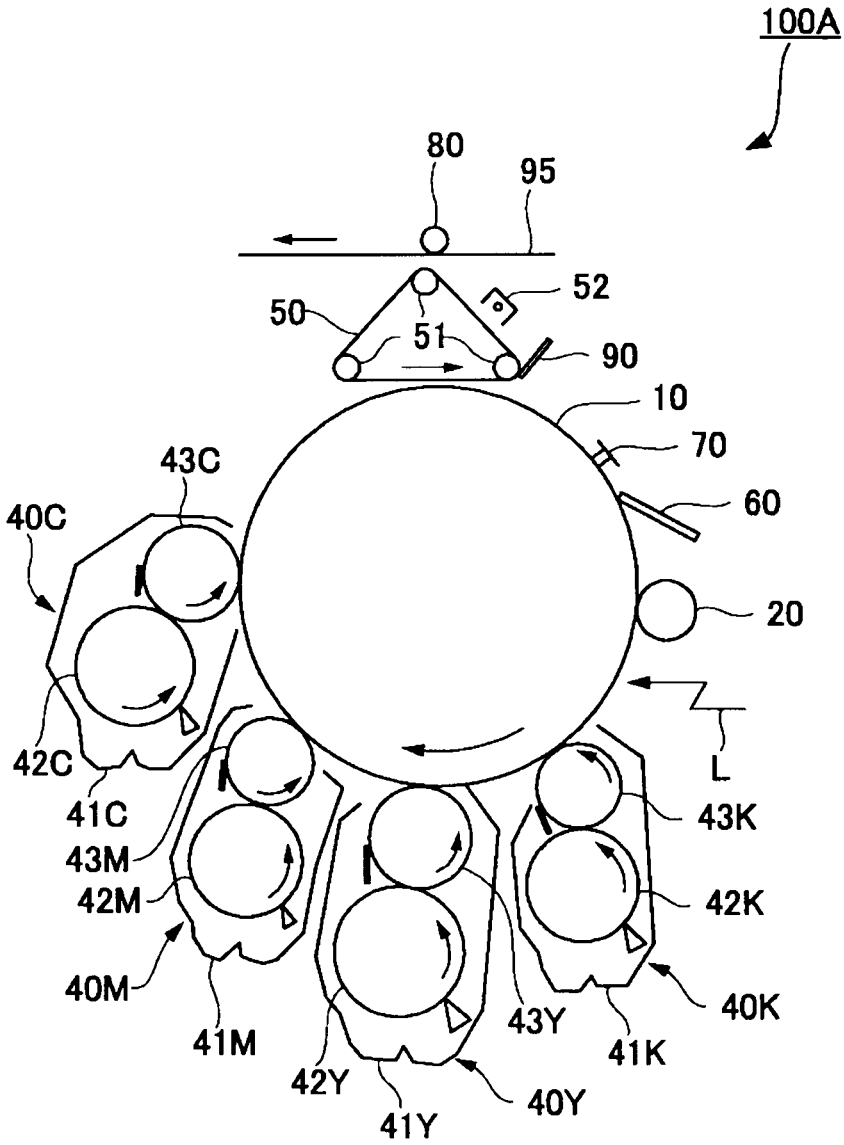
FIG. 1 shows an example of an image forming apparatus used in the present invention.

Hereinafter, a best embodiment for carrying out the present invention will be explained with reference to the drawings.

The toner of the present invention contains base particles produced by dissolving and/or dispersing a toner material in an organic solvent so as to prepare a toner material solution, and emulsifying and/or dispersing the toner material solution in an aqueous medium, wherein the toner material contains a binder resin and a releasing agent. The binder resin contains a polyester resin, and the releasing agent is a hydrocarbon wax which is modified with a carboxylic acid or carboxylic anhydride. Thus, the compatibility between the releasing agent, and the polyester resin and organic solvent having a solubility parameter of 8 $cal^{1/2}\cdot m^{-3/2}$ to 9.8 $cal^{1/2}\cdot m^{-3/2}$ can be adjusted in an appropriate range, and the releasing agent can be maintained in a finely dispersed state in the toner material solution. As a result, the offset resistance as well as the uniform composition and particle diameter of the base particles can be maintained.

In the present invention, the binder resin contains a polyester resin in order to obtain excellent low-temperature fixing property, and more preferably contains an unmodified polyester resin (a polyester which is not modified). The molecular mass, constituent monomer and the like of the polyester resin may be suitably selected according to the purpose. The binder resin may further contain resins other than the polyester resin. Examples of the resins other than the polyester resin include homopolymers such as styrene monomers, acrylic monomers and methacrylic monomers and copolymers thereof; polyol resins, phenol resins, silicone resins, polyurethane resins, polyamide resins, furan resins, epoxy resins, xylene resins, terpene resins, coumarone-indene resins, polycarbonate resins and petroleum resins. These may be used alone or in combination.

The polyester resin can be obtained by dehydration condensation of polyol and polycarboxylic acid. Examples of polyols include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A and divalent alcohol obtained by adding cyclic ether, such as ethylene oxide and propylene oxide, to bisphenol A. To crosslink the polyester resin, polyols of trivalent or higher are preferably used in combination. Examples thereof include sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methylpropane triol, 2-methyl-1,2,4-butane triol, trimethylol ethane, trimethylol propane and 1,3,5-trihydroxybenzene.

Examples of polycarboxylic acids include benzenedicarboxylic acids such as phthalic acid, isophthalic acid, terephthalic acid and anhydrides thereof; alkyldicarboxylic acids such as succinic acid, adipic acid, sebacic acid, azelaic acid and anhydrides thereof; unsaturated dibasic acids such as maleic acid, citraconic acid, itaconic acid, alkenyl succinic acid, fumaric acid and mesaconic acid; unsaturated dibasic acid anhydrides such as maleic anhydride, citraconic anhydride, itaconic anhydride and alkenyl succinic anhydride; trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetrakis(methylenecarboxyl)methane, 1,2,7,8-octanetetracarboxylic acid, ENPOL trimer acid, anhydrides thereof and partial lower alkyl esters thereof.

In the present invention, the polyester resin preferably has an acid value of 5 mg KOH/g to 40 mg KOH/g, and more preferably 10 mg KOH/g to 20 mg KOH/g. The acid value of less than 5 mg KOH/g may reduce the compatibility of the polyester resin with a paper as a main recording medium, and thus, low-temperature fixing property may be lowered. Additionally, a negative electrostatic property may be hard to be obtained, and thus an image to be formed may be adversely affected. The acid value of more than 40 mg KOH/g may adversely affect a formed image in an environment such as high temperature and high humidity, low temperature and low humidity and the like.

The molecular mass distribution of a THF soluble component in the polyester resin preferably has at least a peak in the area of a molecular mass of 3,000 to 50,000, and more preferably has at least a peak in the area of a molecular mass of 5,000 to 20,000, in terms of toner fixing property and offset resistance. Moreover, for the THF soluble component in the polyester resin, the amount of the component having a molecular mass of 100,000 or less is 60% by mass to 100% by mass. The molecular mass distribution of the polyester resin is measured by gel permeation chromatography (GPC) using THF as a solvent.

In the present invention, the binder resin preferably contains a polyester resin having a functional group reactive with an active hydrogen group (hereinafter referred to as polyester prepolymer). A polyester prepolymer having an isocyanate group may be used. Such polyester prepolymer can be obtained by, for example, reaction of a polyester resin having an active hydrogen group with polyisocyanate.

Examples of the active hydrogen groups in the polyester resin include hydroxyl groups such as alcoholic hydroxyl groups and phenolic hydroxyl groups; amino groups; carboxyl groups and mercapto groups. Of these, alcoholic hydroxyl groups are preferable.

The polyester resin and polyester prepolymer are preferably at least partially compatible with each other in terms of low-temperature fixing property and hot offset resistance. Therefore, the compositions of polyester resin and polyester prepolymer are preferably similar to each other.

Examples of the polyisocyanates include aliphatic polyisocyanates such as tetramethylene diisocyanate, hexamethylene diisocyanate and 2,6-diisocyanate methyl caproate; alicyclic polyisocyanates such as isophorone diisocyanate, cyclohexylmethane diisocyanate; aromatic diisocyanates such as tolylene diisocyanate, diphenylmethane diisocyanate; aromatic aliphatic diisocyanates such as α,α,α',α'-tetramethylxylylene diisocyanate; and isocyanurates. These may be used alone or in combination. As polyisocyanates, phenol derivatives thereof, and those blocked with oxime or caprolactam and the like may be used.

When a polyester resin having a hydroxyl group is reacted with polyisocyanate, the equivalent ratio of an isocyanate group to the hydroxyl group, is generally 1 to 5, more preferably 1.2 to 4 and particularly preferably 1.5 to 2.5. When the equivalent ratio is more than 5, the low-temperature fixing property may be lowered. When it is less than 1, the urea content in a modified polyester resin, which is obtained by crosslinking reaction and/or elongation reaction described later, is decreased, and the hot offset resistance may be lowered.

The amount of the component derived from polyisocyanate in the polyester prepolymer is generally 0.5% by mass to 40% by mass, more preferably 1% by mass to 30% by mass, and still more preferably 2% by mass to 20% by mass. When the amount is less than 0.5% by mass, the hot offset resistance may be decreased, making it difficult to simultaneously satisfy the heat resistance and storage stability and the low-temperature fixing property. When the amount is more than 40% by mass, low-temperature fixing property may be lowered.

The number (average number) of isocyanate groups contained in one molecule of the polyester prepolymer is preferably 1 or more, more preferably 1.5 to 3 and still more preferably 1.8 to 2.5. When the number of isocyanate groups is less than 1, the molecular mass of the modified polyester resin which has been crosslinked and/or elongated becomes smaller and the hot offset resistance may be lowered.

The mass ratio of the modified polyester resin to the polyester prepolymer is generally 5/95 to 50/50, more preferably 10/90 to 30/70 and still more preferably 12/88 to 25/75 and the modified polyester resin is preferably 5% by mass to 30% by mass in the total mass of the toner. When the mass ratio is less than 5/95, the hot offset resistance may be lowered, making it difficult to simultaneously satisfy the heat resistance and storage stability and the low-temperature fixing property. When the mass ratio is more than 50/50, the low-temperature fixing property may be poor.

In the present invention, the polyester prepolymer is preferably reacted with an active hydrogen group-containing compound (hereinafter referred to as crosslinking agent and/or elongation agent) in an aqueous medium (hereinafter referred to as crosslinking reaction and/or elongation reaction).

As a crosslinking agent and/or elongating agent, amines can be used. Examples of amines include diamines and trivalent or higher amines, aminoalcohol, aminomercaptan and amino acid. Examples of diamines include aromatic diamines such as phenylene diamine, diethyltoluene diamine and 4,4'-diaminophenylmethane; alicyclic diamines such as 4,4'-diamino-3,3'-dimethyldicycrohexylmethane, diamine cyclohexane and isophorone diamine; aliphatic diamines such as ethylene diamine, tetramethylene diamine and hexamethylene diamine. Examples of trivalent or higher amines include diethylene triamine and triethylene tetramine. Examples of amino alcohols include ethanolamine and hydroxyethylaniline. Examples of amino mercaptans include aminoethylmercaptan and aminopropylmercaptan. Examples of amino acids include aminopropionic acid and aminocaproic acid. As amines, compounds having blocked amino groups, such as ketimine compounds and oxazoline compounds having amino groups blocked with ketones (for example, acetone, methyl ethyl ketone and methyl isobutyl ketone) may be also used. Of these, diamines, a mixture of diamines and a small amount of trivalent or higher amines are preferred.

A reaction terminator may be used to adjust a molecular mass of the modified polyester resin as necessary. Examples of the reaction terminators include monoamines such as diethylamine, dibutylamine, butylamine and laurylamine, and compounds having blocked amino groups of monoamines such as ketimine compounds and oxazoline compounds having amino groups blocked with ketones (for example, acetone, methyl ethyl ketone and methyl isobutyl ketone).

In the crosslinking reaction and/or elongation reaction, the equivalent ratio of the amino group in the amines to the isocyanate group in the polyester prepolymer is preferably ⅓ to 3, more preferably ½ to 2 and particularly preferably from ⅔ to 1.5. When the equivalent ratio is more than 3 and less than ⅓, the molecular mass of the modified polyester resin is decreased, and the hot offset resistance may be lowered.

In terms of toner storage property, the binder resin preferably has a glass transition temperature (Tg) of 35° C. to 80° C., and more preferably 40° C. to 75° C. When the glass transition temperature is less than 35° C., the toner may be easily adversely affected in a high temperature atmosphere, and additionally, offset may easily occur when fixing. When the glass transition temperature is more than 80° C., the fixing property may be lowered.

In the present invention, the dispersibility of the releasing agent in the base particles can be improved, because the releasing agent is a hydrocarbon wax which is modified with a carboxylic acid or maleic anhydride. The hydrocarbon wax is used because of its low melt viscosity and excellent separation property with a polyester resin, and the hydrocarbon wax modified with a carboxylic acid or carboxylic anhydride, and preferably one modified with maleic anhydride is used, because the dispersibility of the releasing agent is improved in the toner material solution. Generally, the hydrocarbon wax insufficiently interacts (mainly, hydrogen bond) with the polyester resin and organic solvent having a solubility parameter of 8 $cal^{1/2}\cdot m^{-3/2}$ to 9.8 $cal^{1/2}\cdot m^{-3/2}$, thus, crystals grow in the toner material solution, and wax tends to have a coarse dispersion diameter. Therefore, the crystal growth of hydrocarbon wax in the toner material solution can be suppressed by modifying the hydrocarbon wax with a carboxylic acid or carboxylic anhydride so as to introduce a functional group in the hydrocarbon wax, in which the functional group has large interaction with the polyester resin and organic solvent having a solubility parameter of 8 $cal^{1/2}\cdot m^{-3/2}$ to 9.8 $cal^{1/2}\cdot m^{-3/2}$. As a result, the hydrocarbon wax modified with a carboxylic acid or carboxylic anhydride can be maintained in a finely dispersed state in the toner material solution.

Examples of the hydrocarbon waxes include polyolefin wax such as paraffin wax, sazol wax, polyethylene wax and polypropylene wax. These may be used alone or in combination. Of these, paraffin wax having low melting point is preferable in terms of low-temperature fixing property.

A method for modifying a hydrocarbon wax is not particularly limited. Examples thereof include methods disclosed in JP-A Nos. 54-30287, 54-81306, 58-43967, 60-16442, 3-199267 and 2000-10338.

In the present invention, the releasing agent preferably has an acid value of 1 mg KOH/g to 100 mg KOH/g, and more preferably 3 mg KOH/g to 20 mg KOH/g in terms of the dispersibility and offset resistance of the releasing agent. When the acid value is less than 1 mg KOH/g, the dispersibility of the releasing agent is insufficient, and then toner properties such as flowability, charging ability, and fixing property may be lowered. When the acid value is more than 100 mg KOH/g, the releasing agent tends to move to an aqueous medium when the toner material solution is emulsified and/or dispersed in the aqueous medium, and then the amount of the releasing agent in the base particles becomes insufficient and offset resistance may be lowered. Moreover, the releasing agent tends to be localized near the surface of the base particles and easily adheres in a developing device, sometimes causing image deterioration. Additionally, the separation property with the polyester resin is lowered and offset resistance may be insufficient.

An acid value is measured using an automatic potentiometric titrator DL-53 Titrator (manufactured by Mettler-Toledo International Inc.), electrode of DG113-SC (manufactured by Mettler-Toledo International Inc.) and an analysis software: LabX Light Version 1.00.000. The calibration of the device is performed by using a mixed solvent of 120 ml of toluene and 30 ml of ethanol, a measurement temperature is 23° C. and measurement conditions are as follows:

Stir
Speed [%]: 25
Time [s]: 15
EQP titration
Titrant/Sensor
Titrant: $CH_3ONa$
Concentration [mol/L]: 0.1
Sensor: DG115
Unit of measurement: mV
Predispensing to Volume
Volume [ml]: 1.0
Wait time [s]: 0
Titrant addition: Dynamic
dE (set) [mV]: 8.0
dV (min) [mL]: 0.03
dV (max) [mL]: 0.5
Measure mode: Equilibrium controlled
dE [mV]: 0.5
dt [s]: 1.0
t (min) [s]: 2.0
t (max) [s]: 20.0
Recognition
Threshold: 100.0
Steepest jump only: No
Range: No
Tendency: None
Termination
At maximum volume [ml]: 10.0
At potential: No
At slope: No
After number EQPs: Yes
n=1
comb. Termination conditions: No
Evaluation
Procedure: Standard
Potential 1: No
Potential 2: No
Stop for reevaluation: No Specifically, the acid value is measured by a method according to JIS K0070-1992 as follows:

To 120 ml of toluene, 0.5 g of a sample is added, and stirred for about 10 hours at room temperature (23° C.), and then 30 ml of ethanol is further added thereto to prepare a sample solution. Next, the sample solution is titrated with a standardized 0.1 N potassium hydroxide-alcohol solution to obtain titer×[ml]. Next, the acid value is found by the following equation:

$$\text{Acid value}=X\times N\times 56.1/\text{mass of sample [mg KOH/g]}$$

where N represents a factor of 0.1N potassium hydroxide-alcohol solution.

In the present invention, the releasing agent has a melt viscosity at 120° C. of preferably 1.0 mPa·s to 20 mPa·s, and more preferably 1.0 mPa·s to 10 mPa·s in terms of fixing property and offset resistance. When the melt viscosity is less than 1.0 mPa·s, the toner may have poor flowability. When the melt viscosity is more than 20 mPa·s, the toner may have poor offset resistance. The melt viscosity is measured on a Brookfield rotational viscometer.

In the present invention, the releasing agent preferably has a melting point of 50° C. to 90° C. Here, the melting point means a temperature of the endothermic peak at which an endothermic amount is maximized in a differential heat curve obtained by Differential Scanning Calorimetry (DSC). When the melting point is less than 50° C., blocking may easily occur while the toner is stored, and heat resistance and storage stability may be lowered. When the melting point is more than 90° C., low-temperature fixing property may be lowered.

In the present invention, the amount of the releasing agent in the base particles is preferably 1% by mass to 20% by mass, and more preferably 3% by mass to 10% by mass. When the amount is less than 1% by mass, the effect of the releasing agent cannot be sufficiently obtained and hot offset resistance may be lowered. When the amount is more than 20% by mass, the flowability of the toner may be lowered and the toner may adhere to other members in a developing device, sometimes causing image deterioration. The amount of the releasing agent is obtained by measuring an endothermic peak of DSC in the same manner as obtaining the melting point. Specifically, DSC measurement of a certain mass of a releasing agent is preliminarily performed to obtain the amount of heat required to melt the releasing agent per unit mass Qw [J/mg]. Next, DSC measurement on a certain mass of the base particles is similarly performed, and the amount of heat required to melt the releasing agent contained in the base particles per unit mass Qt [J/mg] is determined from an area of the endothermic peak of the releasing agent. The amount of the releasing agent W(x) in the base particles is determined by the following equation:

$$W(x)=Qt/Qw\times 100\text{[\% by mass]}$$

Figure 5:
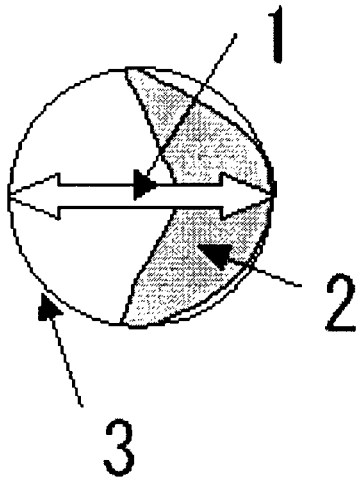
FIG. 5 is a schematic view showing a dispersion diameter (particle diameter in the maximum diameter direction) of a wax particle.

In the present invention, the releasing agent is preferably dispersed in the base particles, and has a dispersion diameter (particle diameter in the maximum diameter direction) preferably of 0.05 μm to 1.0 μm, and more preferably of 0.1 μm to 0.3 μm. When the dispersion diameter is more than 1.0 μm, the amounts of the releasing agent contained in the base particles vary among the base particles, and charging property and flowability of the toner may be lowered and the releasing agent may adhere to a developing device. As a result, a high quality image may not be obtained. When the dispersion diameter is less than 0.05 μm, the ratio of the releasing agent in the base particles is increased and the releasing property may be lowered. The measurement method of the dispersion diameter is not particularly limited, and the following method may be used: First, base particles are embedded in an epoxy resin and it is cut out into an approximately 100 nm ultrathin section, and then stained with ruthenium tetroxide. Next, the stained sample is observed on a transmission electron microscope (TEM) at a magnification of 10,000×, and an image of TEM picture is evaluated. According to the above procedure, a dispersion state of the releasing agent is observed, and the dispersion diameter of the releasing agent can be measured. Note that a dispersion diameter (particle diameter in the maximum diameter direction) 1 is equal to a radius of the minimum circumscribed circle 3 which is formed to entirely surround an image of a wax particle 2 formed in an indefinite shape, which is nearly a spindle shape (FIG. 5).

In the present invention, the toner material may further contain a colorant and charge control agent.

The colorant is not particularly limited and may be suitably selected from known dyes and pigments according to the purpose; examples thereof include carbon blacks, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian green, emerald green, pigment green B, naphthol green B, green gold, acid green lake, malachite green lake, phthalocyanine green, anthraquinone green, titanium oxide, zinc flower and lithopone. These may be used alone or in combination.

The amount of the colorant in the toner material is preferably 1% by mass to 15% by mass, and more preferably 3% by mass to 10% by mass. When it is less than 1% by mass, the coloring power of the toner is lowered, and when it is more than 15% by mass, a pigment is likely to be insufficiently dispersed in the toner, resulting in poor coloring power or electric properties of the toner.

The colorant may be combined with a resin to form a masterbatch. The resins is not particularly limited and may be suitably selected from known resins according to the purpose; examples thereof include polyesters, polymers of styrenes or substituted styrenes, styrene copolymers, polymethyl methacrylates, polybuthyl methacrylates, polyvinyl chlorides, polyvinyl acetates, polyethylenes, polypropylenes, epoxy resins, epoxy polyol resins, polyurethanes, polyamides, polyvinyl butyral, polyacrylic acid resins, rosins, modified rosins, terpene resins, aliphatic hydrocarbon resins, alicyclic hydrocarbon resins, aromatic petroleum resins, chlorinated paraffin and paraffin wax. These may be used alone or in combination.

Examples of polymers of styrenes or substituted styrenes include polystyrene, poly(p-chlorostyrene) and polyvinyl toluene. Examples of styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-butyl acrylate copolymers, styrene-octyl acrylate copolymers, styrene-ethyl methacrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic ester copolymers.

The masterbatches may be obtained by mixing or kneading a resin and a colorant with high shear force. In order to improve interaction between the colorant and the resin, an organic solvent may be preferably added to the colorant and the resin. In addition, the "flushing process" in which a wet cake of a colorant is applied directly is preferable because drying is not necessary. In the flushing process, a water-based paste containing a colorant and water is mixed or kneaded with a resin and an organic solvent so that the colorant moves towards the resin, and that the water and the organic solvent are removed. The materials are preferably mixed or kneaded using a high-shear dispersing device, such as a triple roll mill.

The charge control agent is not particularly limited and may be suitably selected from those known according to the purpose. Examples thereof include nigrosine dyes, triphenylmethane dyes, chromium-containing metal complex dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. These may be used alone or in combination.

The charge control agent may be of commercially available ones. Specific examples thereof include nigrosin dye BONTRON 03, quaternary ammonium salt BONTRON P-51, metal-containing azo dye BONTRON S-34, oxynaphthoic acid metal complex E-82, salicylic metal complex E-84, phenolic condensate E-89 (all produced by Orient Chemical Industries Ltd.), quaternary ammonium salt molybdenum complex TP-302 and TP-415 (all produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (all produced by Hochst), LRA-901, boron complex LR-147 (all produced by Japan Carlit Co., Ltd.), copper phthalocyanine, perylene, quinacridone, azo pigment, and high-molecular-mass-compounds having a functional group such as a sulfonic acid group, carboxyl group, quaternary ammonium salt group and the like.

The amount of the charge control agent in the toner composition is preferably 0.1 parts by mass to 10 parts by mass, and more preferably 0.2 parts by mass to 5 parts by mass based on 100 parts by mass of the binder resin. When the amount is less than 0.1 parts by mass, the charge may be uncontrollable. When the amount is more than 10 parts by mass, charging ability of the toner becomes excessively large, and the effect of the charge control agent itself is decreased while the electrostatic attraction force with a developing roller is increased, causing poor flowability of toner and image density.

The toner of the present invention may further contain inorganic fine particles, a cleaning improver, a magnetic material, and the like.

The inorganic fine particles are preferably used as an external additive to add flowability, developing ability and charging ability of toner particles. The inorganic fine particles are not particularly limited and may be suitably selected from those known according to the purpose. Examples thereof include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide and silicon nitride. These may be used alone or in combination.

The inorganic fine particle has a primary particle diameter preferably of 5 nm to 2 μm and, more preferably of 5 nm to 500 nm.

The amount of the inorganic fine particles in the toner is preferably 0.01% by mass to 5.0% by mass, and more preferably 0.01% by mass to 2.0% by mass.

Moreover, the inorganic fine particles are preferably subjected to surface treatment with a flowability improver so as to improve hydrophobic properties and inhibit the decrease of flowability or charging ability under high humidity environment. Examples of the flowability improvers include a silane coupling agent, a silylation agent, a silane coupling agent having a fluorinated alkyl group, an organotitanate coupling agent, an aluminum coupling agent, silicone oil and modified silicone oil. It is preferable that the silica and titanium oxide be subjected to surface treatment with the flowability improver, and they are preferably used as hydrophobic silica and hydrophobic titanium oxide.

The cleaning improver is added to the toner to easily remove the residual toner on a photoconductor or a primary transfer member after transferring. Examples of the cleaning improvers include fatty acid metal salts such as zinc stearate and calcium stearate, polymer fine particles formed by soap-free emulsion polymerization, such as polymethylmethacrylate fine particles and polystyrene fine particles. The polymer fine particles preferably have a narrow particle size distribution and a volume average particle diameter of 0.01 μm to 1 μm.

The magnetic material is not particularly limited and may be suitably selected from those known according to the purpose. Examples thereof include iron powder, magnetite and ferrite. Of these, one having a white color is preferable in terms of tone of toner.

In the present invention, the base particles preferably have a volume average particle diameter (Dv) of 3 μm to 6 μm and a ratio (Dv/Dn) of the volume average particle diameter (Dv) to the number average particle diameter (Dn) is preferably 1.00 to 1.15. As a result, the toner is excellent in heat resistance and storage stability, low-temperature fixing property and hot offset resistance and, particularly, excellent in image glossiness when the toner is used in a full color copier. Moreover, a two-component developer may exhibit less fluctuation in toner particle diameter, even when the toner is repeatedly replenished after consumption thereof for a long period, and even if used (stirred) for a long period of time in a developing unit, good and stable developing properties can be obtained. Conventionally, the amount of a toner having a small particle diameter has been increased after running for a long period because a toner having a large particle diameter is quickly consumed. A one-component developer may exhibit less fluctuation in toner particle diameter even when the toner is repeatedly replenished after consumption thereof, and also bring about less toner filming on a developing roller or toner melt-adhesion onto a member such as a blade for reducing a thickness of a toner layer, thereby providing excellent and stable developing property and images over long-term use (stirring) of a developing unit.

Generally, it is said that a toner having a smaller particle diameter is advantageous for obtaining high resolution and high quality image, but that it is disadvantageous for transfer property and cleaning ability. When the toner containing base particles having a volume average particle diameter Dv of less than 3 μm is used in a two-component developer, the toner of two-component developer is liable to melt and adhere onto a carrier surface as a result of stirring in a developing unit for a long period, the charging ability of the carrier may be decreased. On the other hand, the toner used as a one-component developer is liable to cause toner filming to a developing roller or melt-adhesion to a member such as a blade for reducing a thickness of a toner layer.

When the toner containing base particles having a volume average particle diameter Dv of more than 6 μm and a Dv/Dn ratio of more than 1.25, a high resolution and high quality image is rarely obtained, and the toner particle diameter may fluctuate after consumption or replenishment of the toner.

The volume-average particle diameter Dv and the number-average particle diameter Dn are measured at an aperture diameter of 100 μm on a particle size analyzer ("Multisizer III," manufactured by Beckman Coulter, Inc.), and are analyzed by an analysis software (Beckman Coulter Multisizer 3 Version 3.51). Specifically, in a 100 ml glass beaker, 0.5 ml of a 10% by mass of aqueous solution of alkylbenzene sulfonate, NEOGEN SC-A (manufactured by Daiichi Kogyo Seiyaku Co., Ltd.) is loaded, then 0.5 g of base particles are added thereto and stirred with a microspatula, and then 80 ml of ion-exchanged water is added. The thus obtained dispersion is dispersed in an ultrasonic dispersing machine (W-113MK-II, manufactured by Honda Electronics Co., Ltd.) for 10 minutes. The properties of the sample dispersion are measured on the Multisizer III, using Isoton III (manufactured by Beckman Coulter, Inc.) as a solution for measurement. The measurement is performed by dropping the sample dispersion such that the concentration thereof indicated by the Multisizer III reaches 8±2%. In the measurement method, it is important to adjust the concentration of the sample dispersion to 8±2% from the point of measurement reproducibility of the particle diameter.

The physical properties such as the shape, size, and the like of the toner of the present invention are not particularly limited and may be suitably selected according to the purpose. Preferably, the toner has the following penetration, low-temperature fixing property, offset non-occurrence temperature, and the like.

The toner of the present invention has a penetration of preferably 15 mm or more and, more preferably 20 mm to 30 mm in accordance with a penetration test (JIS K2235-1991). When the penetration is less than 15 mm, heat resistance and storage stability may be poor. The penetration is measured in accordance with JIS K2235-1991. Specifically, the penetration is measured by filling a 50 ml glass vessel with a toner, leaving the glass container filled with the toner in a thermostat at 50° C. for 20 hours, subsequently cooling the toner to an ambient temperature, and then carrying out a penetration test thereto. Note that, the higher the penetration is, the more excellent heat resistance and storage stability the toner has.

In terms of the low-temperature fixing property of the toner, the lowest fixing temperature is less than 150° C. and the offset non-occurrence temperature, a temperature at which offset does not occur, is 200° C. or more. The lowest fixing temperature is determined as follows: a copy test is carried out using an image forming apparatus, the obtained fixed image is scrubbed by pads, and the persistence of the image density is measured. The lowest fixing temperature is determined as a temperature of a fixing roll at which the persistence of the image density becomes 70% or more. The offset non-occurrence temperature is measured as follows:

the image-forming apparatus is adjusted so as to develop a solid image in each color of yellow, magenta, cyan and black, as well as intermediate colors of red, blue and green, and so as to vary the temperature of a fixing belt, thereby measuring the offset non-occurrence temperature.

The toner of the present invention is not particularly limited, and may be at least one of a black toner, cyan toner, magenta toner and yellow toner by appropriately selecting a kind of the colorant.

The method for producing the toner according to the present invention includes dissolving and/or dispersing a toner material in an organic solvent so as to form a toner material solution, and emulsifying and/or dispersing the toner material solution in an aqueous medium. More specifically, the method preferably includes the following steps (1) to (6).

(1) Preparation of Toner Material Solution

The toner material solution is prepared by dissolving and/or dispersing the toner material in an organic solvent. The organic solvent is not particularly limited and preferably has a boiling point of less than 150° C. in terms of easy removal. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone and methyl isobutyl ketone. These solvents may be used alone or in combination. Of these, the organic solvent preferably has a solubility parameter of 8 $cal^{1/2}\cdot m^{-3/2}$ to 9.8 $cal^{1/2}\cdot m^{-3/2}$, and more preferably a solubility parameter of 8.5 $cal^{1/2}\cdot m^{-3/2}$ to 9.5 $cal^{1/2}\cdot m^{-3/2}$ in terms of the excellent solubility of the polyester resin. Moreover, ester solvents and ketone solvents are preferable because they largely interact with a modification group in the releasing agent, and can effectively suppress the crystal growth of the releasing agent. Particularly, ethyl acetate and methyl ethyl ketone are more preferable in terms of easy removal.

The amount of the organic solvent may be suitably selected according to the purpose; the amount is preferably 40 parts by mass to 300 parts by mass, more preferably 60 parts by mass to 140 parts by mass, and particularly preferably 80 parts by mass to 120 parts by mass based on 100 parts by mass of the toner material.

In the present invention, it is preferred that the binder resin and the releasing agent be heated and dissolved in the organic solvent, and then cooled to prepare the toner material solution. Thus, the releasing agent can be well dispersed.

(2) Preparation of Aqueous Medium

The aqueous medium can be prepared by dispersing resin fine particles in an aqueous solvent. The amount of the resin fine particles in the aqueous solvent is not particularly limited and may be suitably selected according to the purpose. It is preferably 0.5% by mass to 10% by mass.

The aqueous solvent is not particularly limited and may be suitably selected from those known; examples thereof include water, water-miscible solvents, and combinations thereof. Of these, water is particularly preferable. Examples of the water-miscible solvents include alcohols such as methanol, isopropanol and ethylene glycol; dimethylformamide; tetrahydrofuran; cellosolves; and lower ketones such as acetone and methyl ethyl ketone.

The resin fine particles are not particularly limited and may be any resin as long as it can be dispersed in an aqueous solvent. The resin fine particles may be of thermoplastic resins or thermosetting resins; examples thereof include vinyl resins, polyurethane resins, epoxy resins, polyester resins, polyamide resins, polyimide resins, silicone resins, phenol resins, melamine resins, urea resins, aniline resins, ionomer resins and polycarbonate resins. These may be used alone or in combination. Of these, the resin fine particles formed of at least one selected from the vinyl resins, polyurethane resins, epoxy resins, and polyester resins are preferable by virtue of easily producing aqueous dispersion of spherical resin fine particles. The vinyl resins are resins obtained by mono- or co-polymerizing a vinyl monomer. Examples of vinyl resins include styrene-(meth)acrylate ester copolymers, styrene-butadiene copolymers, (meth)acrylate-acrylic acid ester copolymers, styrene-acrylonitrile copolymers, styrene-maleic anhydride copolymers, and styrene-(meth)acrylate copolymers.

The resin fine particles may be formed using a monomer having at least two or more unsaturated groups. Examples of the monomers having two or more unsaturated groups include sodium salt of sulfate ester of methacrylic acid ethylene oxide adduct, divinylbenzene and 1,6-hexane diol acrylate.

The resin fine particles may be formed through known polymerization processes, and are preferably produced into an aqueous dispersion of resin fine particles. Examples of preparation processes of the aqueous dispersion include the following (a) to (h): (a) a direct preparation process of aqueous dispersion of the resin fine particles in which, in the case of a vinyl resin, a vinyl monomer as a raw material is polymerized by a suspension-polymerization process, emulsification-polymerization process, seed polymerization process or dispersion-polymerization process; (b) a preparation process of aqueous dispersion of the resin fine particles in which, in the case of a polyaddition or condensation resin such as a polyester resin, polyurethane resin, epoxy resin or the like, a precursor (monomer, oligomer or the like) or solvent solution thereof is dispersed in an aqueous medium in the presence of a dispersant, and heated or added with a curing agent so as to be cured; (c) a preparation process of aqueous dispersion of the resin fine particles in which, in the case of a polyaddition or condensation resin such as a polyester resin, polyurethane resin, epoxy resin or the like, a suitably selected emulsifier is dissolved in a precursor (monomer, oligomer or the like) or solvent solution thereof (preferably being liquid, or being liquidized by heating), and then water is added so as to induce phase inversion emulsification; (d) a preparation process of aqueous dispersion of the resin fine particles, in which a resin, previously prepared by polymerization process which may be any of addition polymerization, ring-opening polymerization, polyaddition, addition condensation, or condensation polymerization, is pulverized by means of a pulverizing mill such as a mechanical rotation-type, jet-type or the like, and classified to obtain resin fine particles, and then the resin fine particles are dispersed in an aqueous medium in the presence of a suitably selected dispersant; (e) a preparation process of aqueous dispersion of the resin fine particles, in which a resin, previously prepared by a polymerization process which may be any of addition polymerization, ring-opening polymerization, polyaddition, addition condensation or condensation polymerization, is dissolved in a solvent, the resultant resin solution is sprayed in the form of a mist to thereby obtain resin fine particles, and then the resulting resin fine particles are dispersed in an aqueous medium in the presence of a suitably selected dispersant; (f) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent, the resultant resin solution is subjected to precipitation by adding a poor solvent or cooling after heating and dissolving, the solvent is removed to thereby obtain resin fine particles, and then the resulting resin fine particles are dispersed in an aqueous medium in the presence of a suitably selected dispersant; (g) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent to thereby obtain a resin solution, the resin solution is dispersed in an aqueous medium in the presence of a suitably selected dispersant, and then the solvent is removed by heating or reduced pressure; (h) a preparation process of aqueous dispersion of the resin fine particles, in which a resin, previously prepared by a polymerization process, which is any of addition polymerization, ring-opening polymerization, polyaddition, addition condensation or condensation polymerization, is dissolved in a solvent to thereby obtain a resin solution, a suitably selected emulsifier is dissolved in the resin solution, and then water is added to the resin solution so as to induce phase inversion emulsification.

When preparing the aqueous dispersion, the aqueous medium preferably contains a dispersant as necessary at the time of emulsifying and/or dispersing the toner material solution in order to stabilize oil droplets and sharpen the particle size distribution while yielding a desirable shape. The dispersant is not particularly limited and may be suitably selected according to the purpose; examples thereof include surfactants, poorly water-soluble inorganic dispersants and polymeric protective colloids. These may be used alone or in combination. Of these, anionic surfactants, cationic surfactants, nonionic surfactants and ampholytic surfactants are preferable.

Examples of anionic surfactants include alkylbenzene sulfonic acid salts, α-olefin sulfonic acid salts, phosphoric acid esters and anionic surfactants having a fluoroalkyl group. Examples of the anionic surfactants having a fluoroalkyl group include fluoroalkyl carboxylic acids having 2 to 10 carbon atoms and metal salts thereof, disodium perfluorooctanesulfonylglutamate, sodium-3-[omega-fluoroalkyl (C6 to C11)oxy]-1-alkyl (C3 to C4) sulfonate, sodium-3-[omega-fluoroalkanoyl (C6 to C8)-N-ethylamino]-1-propanesulfonate, fluoroalkyl (C11 to C20) carboxylic acids and metal salts thereof, perfluoroalkyl (C7 to C13) carboxylic acids and metal salts thereof, perfluoroalkyl (C4 to C12) sulfonic acid and metal salt thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycine salts and monoperfluoroalkyl (C6 to C16) ethylphosphate ester. Examples of commercially available anionic surfactants having a fluoroalkyl group include Surflon S-111, S-112 and S-113 (by Asahi Glass Co., Ltd.); Frorard FC-93, FC-95, FC-98 and FC-129 (by Sumitomo 3M Ltd.); Unidyne DS-101 and DS-102 (by Daikin Industries, Ltd.); Megafac F-110, F-120, F-113, F-191, F-812 and F-833 (by Dainippon Ink and Chemicals, Inc.); ECTOP EF-102, 103, 104, 105, 112, 123A, 123B, 306A, 501, 201 and 204 (by Tohchem Products Co., Ltd.); Futargent F-100 and F-150 (by Neos Co., Ltd.).

Examples of cationic surfactants include amine salt surfactants, quaternary ammonium salt surfactants and cationic surfactants having a fluoroalkyl group. Examples of amine salt surfactants include alkyl amine salts, amino alcohol fatty acid derivatives, polyamine fatty acid derivatives and imidazoline. Examples of quaternary ammonium salt surfactants include alkyltrimethyl ammonium salts, dialkyldimethyl ammonium salts, alkyldimethyl benzyl ammonium salts, pyridinium salts, alkyl isoquinolinium salts and benzethonium chloride. Of the cationic surfactants having a fluoroalkyl group, preferably used are primary, secondary or tertiary aliphatic amine acids having a fluoroalkyl group, aliphatic quaternary ammonium salts such as perfluoroalkyl (C6 to C10) sulfoneamidepropyl trimethylammonium salt, benzalkonium salts, benzetonium chloride, pyridinium salts and imidazolinium salts. Specific examples of commercially available products of the cationic surfactants include Surflon S-121 (by Asahi Glass Co., Ltd.) Frorard FC-135 (by Sumitomo 3M Ltd.), Unidyne DS-202 (by Daikin Industries, Ltd.), Megafack F-150 and F-824 (by Dainippon Ink and Chemicals, Inc.), Ectop EF-132 (by Tohchem Products Co., Ltd.), and Futargent F-300 (by Neos Co., Ltd.).

Examples of nonionic surfactants include fatty acid amide derivatives and polyol derivatives.

Examples of ampholytic surfactants include alanine, dodecylbis(aminoethyl)glycine, bis(octylaminoethyl)glycine and N-alkyl-N,N-dimethylammonium betaine.

Examples of poorly water-soluble inorganic dispersants include tricalcium phosphate, calcium carbonate, titanium oxide, colloidal silica and hydroxyapatite.

Examples of polymeric protective colloids include acid monomers, (meth)acrylic monomers having a hydroxyl group, ethers of vinyl alcohols, esters of vinyl alcohol and compounds having a carboxyl group, monomers having amide bond, methylol compounds of monomers having amide bond, acid chloride monomers, homopolymers or copolymers of monomers having a nitrogen atom or heterocyclic ring containing a nitrogen atom, polyoxyethylenes and celluloses.

Examples of acid monomers include acrylic acid, methacrylic acid, α-cyanoacrylic acid, α-cyanomethacrylic acid, itaconic acid, crotonic acid, fumaric acid, maleic acid and maleic anhydride.

Examples of (meth)acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, glycerin monomethacrylate, N-methylol acrylamido and N-methylol methacrylamide.

Examples of ethers of vinyl alcohol include vinyl methyl ether, vinyl ethyl ether and vinyl propyl ether.

Examples of esters of vinyl alcohol and a compound having a carboxyl group include vinyl acetate, vinyl propionate and vinyl butyrate.

Examples of monomers having an amide bond include acryl amide, methacrylic amide and diacetone acrylic amide acid.

Examples of acid chloride monomers include acrylic chloride and methacrylic chloride.

Examples of monomers having a nitrogen atom or heterocyclic ring containing a nitrogen atom include vinyl pyridine, vinyl pyrrolidone, vinyl imidazole and ethylene imine.

Examples of polyoxyethylene resins include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenyl ester and polyoxyethylene nonylphenyl ester.

Examples of celluloses include methyl cellulose, hydroxyethyl cellulose and hydroxypropyl cellulose.

In the preparation of the aqueous dispersion of the resin fine particles, a dispersion stabilizer may be used as necessary. The dispersion stabilizer is, for example, an acid- and alkali-soluble compound such as calcium phosphate salt, and the like.

When the binder resin contains polyester prepolymer, the aqueous medium may contain a catalyst for urea reaction, urethane reaction, such as dibutyltin laurate, dioctyltin laurate and the like.

(3) Preparation of Emulsified Slurry

An emulsified slurry is prepared by emulsifying and/or dispersing the toner material solution in an aqueous medium, and preferably emulsified and/or dispersed in the aqueous medium while stirring. Examples of equipment for emulsification and/or dispersion include: batch type emulsifiers such as Homogenizer (manufactured by IKA Co., Ltd.), Polytron (manufactured by Kinematica Co. Ltd.), TK Auto Homomixer (manufactured by Primix Corp.); continuous emulsifiers such as Ebara Milder (manufactured by Ebara Corp.), TK fillmix, TK Pipeline Homomixer (manufactured by Primix Corp.), Colloid Mill (manufactured by Kobelco Eco-Solutions Co., Ltd.), Slasher, Trigonal wet-type mill (manufactured by Mitsui Miike Machinery Co., Ltd.), Cavitron (manufactured by Eurotec Co., Ltd.), and Fine flow mill (manufactured by Pacific Machinery & Engineering Co., Ltd.); high-pressure emulsifiers such as Microfluidizer (manufactured by Mizuho Industrial Co., Ltd.), Nanomizer (manufactured by Nanomizer Co., Ltd.) and APV Gaulin (manufactured by Gaulin Co., Ltd.); membrane emulsifiers such as a membrane emulsifier (manufactured by Reica Co., Ltd.); vibration emulsifiers such as Vibro Mixer (manufactured by Reica Co., Ltd.); and ultrasonic emulsifiers such as Ultrasonic Homogenizer (manufactured by Branson Co., Ltd.). Of these, APV Gaulin, Homogenizer, TK Auto Homomixer, Ebara Milder, TK fillmix, and TK Pipeline Homomixer are preferably used in terms of uniform particle diameter.

(4) Removal of Organic Solvent

The removal of organic solvent from the emulsified slurry is carried out, for example, by the following methods: (1) the temperature of a reaction system is gradually raised, and the organic solvent in emulsification or dispersion is evaporated and removed; (2) an emulsified dispersion is sprayed in a dry atmosphere so as to remove the organic solvent, and to evaporate and remove an aqueous solvent.

(5) Washing, Drying, and Classification

Once the organic solvent is removed from the emulsified slurry, base particles are formed. The base particles are then subjected to washing, drying, and the like, then the base particles may be classified as necessary. The classification may be carried out, for example, using a cyclone, decanter, or centrifugal separation so as to remove fine particles in the aqueous medium, or carried out after the base particles are dried.

When an acid- and alkali-soluble compound such as calcium phosphate salt is used as a dispersion stabilizer, the dispersion stabilizer is dissolved with an acid such as hydrochloric acid, and then washed with water so as to be removed from the base particles.

(6) External Addition of Inorganic Fine Particles

The base particles are mixed with inorganic fine particles such as silica or titanium oxide as necessary and mechanical impact is applied thereto, thereby preventing the inorganic fine particles from falling off the surfaces of the base particles. Examples of the methods of applying mechanical impact include a method in which impact is applied to the particles by means of a blade rotating at high speed, and a method in which impact is applied by introducing the particles into a high-speed flow to cause particles collide with each other or to cause composite particles to collide against an impact board. Examples of the devices employed for these methods include an angmill (manufactured by Hosokawa micron Co., Ltd.), a modified I-type mill (manufactured by Nippon Pneumatic Mfg. Co., Ltd.) to decrease pulverization air pressure, a hybridization system (manufactured by Nara Machinery Co., Ltd.), a kryptron system (manufactured by Kawasaki Heavy Industries, Ltd.), and automatic mortars.

The toner of the present invention is excellent in properties such as flowability, fixing property and the like, and simultaneously satisfies both excellent low-temperature fixing property, and heat resistance and storage stability. Therefore, the toner of the present invention can be used in various fields, particularly preferably use for image formation by electrophotography.

The developer of the present invention contains at least the toner of the present invention and may further contain other components such as a carrier. The developer is either a one-component developer consisting of a toner or a two-component developer consisting of a toner and a carrier. However, the two-component developer is preferably used in view of improved life span when the developer is used with, for example, a high speed printer that complies with improvements in recent information processing speed. Such developer can be used in image formation by various known electrophotographies such as magnetic one-component developing, non-magnetic one-component developing, and two-component developing.

The developer of the present invention, which is used as a one-component developer, may exhibit less fluctuation in toner-particle diameter even when the toner is repeatedly replenished after consumption thereof, and also bring about less toner filming on a developing roller or toner melt-adhesion onto a member such as a blade for reducing a thickness of a toner layer, thereby providing excellent and stable developing property and images over long-term use (stirring) of a developing unit.

The developer of the present invention, which is used as a two-component developer, may exhibit less fluctuation in the toner particle diameter even when the toner is repeatedly replenished after consumption thereof for a prolonged period, thereby providing excellent and stable developing property and images over long-term use (stirring) of a developing unit.

The amount of the carrier in the two-component developer is preferably 90% by mass to 98% by mass, and more preferably 93% by mass to 97% by mass.

The carrier is not particularly limited and may be suitably selected according to the purpose; the carrier preferably has a core material and a resin layer coated on the core material.

The core material may be suitably selected from those known; examples thereof include manganese-strontium (Mn—Sr) materials and manganese-magnesium (Mn—Mg) materials of 50 emu/g to 90 emu/g. These may be used alone or in combination. Additionally, highly magnetized materials such as iron powder (100 emu/g or more) and magnetite (75 emu/g to 120 emu/g) is used in view of ensuring appropriate image density. Weak-magnetizable materials such as copper-zinc (Cu, Zn) materials (30 emu/g to 80 emu/g) are also preferred in view of reducing the shock to the photoconductor on which the toner stands, which is advantageous for high image quality.

The core material preferably has a volume average particle diameter ($D_{50}$) of 10 μm to 150 μm, and more preferably 20 μm to 80 μm. When the volume average particle diameter ($D_{50}$) is smaller than 10 μm, an increased amount of fine powder is observed in the carrier particle size distribution, and thus magnetization per particle is lowered, and carrier scattering may be caused. When the average particle diameter ($D_{50}$) is larger than 150 μm, the specific surface area is reduced, and toner scattering may be caused. As a result, a full color image having many solid parts may not be well reproduced particularly in the solid parts.

The material for the resin layer may be suitably selected from those known according to the purpose; examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymer of tetrafluoroethylene, vinylidene fluoride and non-fluoride monomer, and silicone resins. These may be used alone or in combination.

Examples of amino resins include urea-formaldehyde resins, melamine resins, benzoguanamine resins, urea resins, polyamide resins, and epoxy resins. Examples of polyvinyl resins include acrylic resins, polymethylmethacrylate resins, polyacrylonitrile resins, polyvinyl acetate resins, polyvinyl alcohol resins and polyvinyl butyral resins. Examples of polystyrene resins include polystyrene resins and styrene acryl copolymer resins. Examples of halogenated olefin resins include polyvinyl chlorides. Examples of polyester resins include polyethyleneterephthalate resins and polybutyleneterephthalate resins.

The resin layer may contain conductive powder, and the like, as necessary. Examples of materials of the conductive powder include metal, carbon black, titanium oxide, tin oxide and zinc oxide. The average particle diameter of the conductive powder is preferably 1 μm or less. When the average particle diameter is more than 1 μm, the electrical resistance may be hard to be controlled.

The resin layer may be formed by dissolving the silicone resins, etc. in a solvent to prepare a coating solution, uniformly applying the coating solution to the surface of core material by known processes, then drying and baking. Examples of the coating processes include immersion, spray and brushing. The solvent is not particularly limited and may be suitably selected according to the purpose; examples thereof include toluene, xylene, methyl ethyl ketone, methyl isobutyl ketone and cellosolve butyl acetate. The baking may be carried out through external or internal heating. Examples of the baking processes include those by use of fixed electric furnaces, flowing electric furnaces, rotary electric furnaces, burner furnaces and microwave.

The amount of the resin layer in the carrier is preferably 0.01% by mass to 5.0% by mass. When the amount is less than 0.01% by mass, the resin layer may be formed nonuniformly on the surface of the core material, and when the amount is more than 5.0% by mass, the resin layer may become excessively thick to cause granulation between carriers, and carrier particles may be formed nonuniformly.

The developer can be preferably used in image formation by various known electrophotographies such as magnetic one-component developing, non-magnetic one-component developing, and two-component developing.

The developer container used in the present invention contains the developer of the present invention. The container is not particularly limited and may be suitably selected from known containers according to the purpose. Examples thereof include the container having a container body and a cap.

The container body is not particularly limited in size, shape, structure and material and may be suitably selected according to the purpose. The container is preferably cylindrical in shape. Those having a spiral ridge on the inner periphery so that the developer therein is shifted to the discharge end as the container rotates and the spiral serves as bellows in part or as a whole are particularly preferable. The material of the container body is not particularly limited and the material preferably has dimensional accuracy. Examples thereof include polyester resins, polyethylene resins, polypropylene resins, polystyrene resins, polyvinyl chloride resins, polyacrylic acid, polycarbonate resins, ABS resins, and polyacetal resins.

The developer container is easy to store, transport, and excellent in handling and can be detachably attached to the process cartridge or image forming apparatus described later for refilling of developer.

An image forming method used in the present invention preferably includes at least a latent electrostatic image forming step, a developing step, a transferring step, a fixing step and more preferably includes a cleaning step, and may include other steps such as discharging, recycling and controlling, as necessary.

An image forming apparatus used in the present invention preferably includes at lest a latent electrostatic image bearing member, a latent electrostatic image forming unit, a developing unit, a transferring unit, a fixing unit and more preferably includes a cleaning unit, and may include other units such as a charge-eliminating unit, a recycling unit and a controlling unit, as necessary.

The image forming method used in the present invention can be carried out by using the image forming apparatus used in the present invention, in which the latent electrostatic image forming step, the developing step, the transferring step, the fixing step and other steps are respectively carried out by the latent electrostatic image forming unit, the developing unit, the transferring unit, the fixing unit and other units.

The latent electrostatic image forming step is a step of forming a latent electrostatic image on the latent electrostatic image bearing member such as optical conductive insulator, photoconductor and the like. Materials, shapes, structures or sizes, etc. of the latent electrostatic image bearing member (sometimes referred to as "electrophotographic photoconductor" or "photoconductor") may be suitably selected from those known and the latent electrostatic image bearing member is preferably of a drum shape. Examples of the materials for the photoconductor include inorganic materials such as amorphous silicon and selenium, and organic materials such as polysilane and phthalopolymethine. Of these, the amorphous silicon photoconductor is preferred by virtue of longer operating life.

A latent electrostatic image may be formed, for example, by uniformly charging a surface of the latent electrostatic image bearing member, and then exposing imagewise by the latent electrostatic image forming unit. The latent electrostatic image forming unit includes at least a charger which uniformly charges the surface of the latent electrostatic image bearing member by applying voltage, and an exposurer which exposes imagewise the surface of the latent electrostatic image bearing member.

The charger is not particularly limited and may be suitably selected according to the purpose; examples thereof include known contact chargers equipped with a conductive or semi-conductive roller, brush, film or rubber blade and non-contact chargers using corona discharges such as corotron and scorotron.

The exposurer is not particularly limited as long as it can expose imagewise the surface of the latent electrostatic image bearing member which has been charged using the charger. Examples of the exposurers include copying optical systems, rod lens array systems, laser optical systems and liquid crystal shutter optical systems. In the present invention, the back-exposure method may be adopted in which the latent electrostatic image bearing member is exposed imagewise from the back side.

The developing step is a step of developing a latent electrostatic image using the developer of the present invention to form a toner image (visible image). The toner image may be formed by developing a latent electrostatic image using the developer by the developing unit. The developing unit is not particularly limited and may be any one as long as it can develop an image by using the developer of the present invention. For example, a preferable developing unit contains a developing device which contains the developer of the present invention and can apply the toner in a contact or non-contact manner to a latent electrostatic image and is equipped with a developer container used in the present invention. The developing device may be of dry-type or wet-type, and may also be of monochrome or multi-color. As a preferable example, the developing device has a stirrer for frictioning and stirring the developer of the present invention to be charged, and a rotatable magnet roller. In the developing device, the toner and the carrier may be mixed and stirred together. The toner is charged by friction, and forms a magnetic brush on the surface of the rotating magnet roller. Since the magnet roller is arranged near the latent electrostatic image bearing member, a part of the toner constructing the magnetic brush formed on the surface of the magnet roller is moved toward the surface of the latent electrostatic image bearing member due to the force of electrical attraction. As a result, the latent electrostatic image is developed using the toner, and the toner image is formed on the surface of the latent electrostatic image bearing member. The developer contained in the developing device is the developer of the present invention, which may be either a one-component developer or a two-component developer.

The transferring step is a step of transferring the toner image to a recording medium by charging the latent electrostatic image bearing member on which the toner image is formed using the transferring unit such as a transfer charger. It is preferred that the transferring step is carried out in such a way that the toner image is primarily transferred on an intermediate transfer medium, then the toner image is secondarily transferred from the intermediate transfer medium to the recording medium; it is more preferred that toners of two or more colors, preferably full-color toners are employed, and the transferring step is carried out by way of a primary transferring step in which toner images are transferred on the intermediate transfer medium to form a complex toner image and a secondary transferring step in which the complex toner image is transferred from the intermediate transfer medium to the recording medium.

The transferring unit is not particularly limited and preferably includes a primary transferring unit configured to transfer toner images to the intermediate transfer medium to form a complex toner image and a secondary transferring unit configured to transfer the complex toner image from the intermediate transfer medium to the recording medium. The intermediate transfer medium is not particularly limited, for example, endless belts are used. The transferring units (primary transferring unit and secondary transferring unit) preferably include at least a transfer device that separates and charges the toner image formed on the latent electrostatic image bearing member (photoconductor) to the side of the recording medium. The transferring unit may include one or plural transfer devices.

Examples of the transfer devices include corona transfer devices on the basis of corona discharge, transfer belts, transfer rollers, pressure transfer rollers and adhesive transfer devices.

The recording medium is not particularly limited and may be suitably selected from known recording media (recording paper).

The fixing step is a step of fixing the toner image transferred to the recording medium using the fixing unit. The fixing may be carried out for each color upon transferred onto the recording medium, or simultaneously after all colors are laminated when toners of two or more colors are used. The fixing unit is not particularly limited and may be suitably selected from known heating and pressing units according to the purpose; examples thereof include combinations of heating rollers and pressing rollers, and combinations of heating rollers, pressing rollers and endless belts. The heating temperature in the heating and pressing units is preferably 80° C. to 200° C. In addition, in the present invention, known optical fixing units may be used along with or in place of the fixing unit, as necessary.

The charge-eliminating step is a step of applying a charge-eliminating bias to the latent electrostatic image bearing member by the charge-eliminating unit. The charge-eliminating unit is not particularly limited as long as it can apply a charge-eliminating bias to the latent electrostatic image bearing member, and may be suitably selected from those known; examples thereof include charge-eliminating lamps.

The cleaning step is a step of removing residual toner on the latent electrostatic image bearing member by the cleaning unit. The cleaning unit is not particularly limited and any cleaning unit may be used as long as it can remove residual toner on the latent electrostatic image bearing member; examples thereof include magnetic brush cleaners, electrostatic brush cleaners, magnetic roller cleaners, blade cleaners, brush cleaners, and web cleaners.

The recycling step is a step of recycling the toner removed in the cleaning step for use in the developing unit, which may be performed by the recycling unit. The recycling unit is not particularly limited and may be suitably selected from known transport units.

The controlling step is a step of controlling the respective processes by the controlling unit. The controlling unit is not particularly limited as long as it can control the performance of each unit and may be suitably selected according to the purpose. Examples thereof include instruments such as sequencers or computers, etc.

An example of the image forming apparatus used in the present invention is shown in FIG. 1. An image forming apparatus 100A shown in FIG. 1 contains a photoconductor drum 10 (hereinafter referred to as "photoconductor 10") as a latent electrostatic image bearing member, a charging roller 20 as a charging unit, an exposing device (not shown) as an exposing unit, a developing device 40 as a developing unit, an intermediate transfer medium 50, a cleaning device 60 as a cleaning unit having a cleaning blade, and a charge eliminating lamp 70 as a charge eliminating unit.

The intermediate transfer medium 50 is an endless belt being stretched around the three rollers 51 which are placed inside the belt and designed to be movable in an arrow direction in FIG. 1. A part of three rollers 51 functions as a transfer bias roller capable of applying a specified transfer bias (primary transfer bias), to the intermediate transfer medium 50.

The cleaning blade 90 for intermediate transfer medium is placed near the intermediate transfer medium 50, and a transfer roller 80 as a transferring unit capable of applying a transfer bias for transferring (secondarily transferring) the toner image (visible image) onto a recording medium 95, is placed with facing the intermediate transfer medium 50.

In the surrounding area of the intermediate transfer medium 50, a corona charger 52 for applying charge to the toner image on the intermediate transfer medium 50 is placed between a contact area of the photoconductor 10 and the intermediate transfer medium 50, and a contact area of the intermediate transfer medium 50 and the recording medium 95.

Respective developing devices 40 for black (K), yellow (Y), magenta (M) and cyan (C) contain developer containers 41 and developer feeding rollers 42 and developing rollers 43.

In the image forming apparatus 100A, the charging roller 20 uniformly charges the photoconductor 10, and then the photoconductor 10 is exposed imagewise using light L by means of an exposing device (not shown) so as to form a latent electrostatic image. The latent electrostatic image formed on the photoconductor drum 10 is then developed with the developer fed from the developing device 40 to form a toner image (visible image). The toner image (visible image) is then primarily transferred onto the intermediate transfer medium 50 by a transfer bias applied from rollers 51 and the toner image on the intermediate transfer medium 50 is charged by a contact charger 52, and then is secondarily transferred onto the transfer medium 95. As a result, a transfer image is formed on the transfer medium 95. The residual toner on the photoconductor 10 is removed by the cleaning device 60 and the charge built up over the photoconductor 10 is temporarily removed by the charge eliminating lamp 70.

Figure 2:
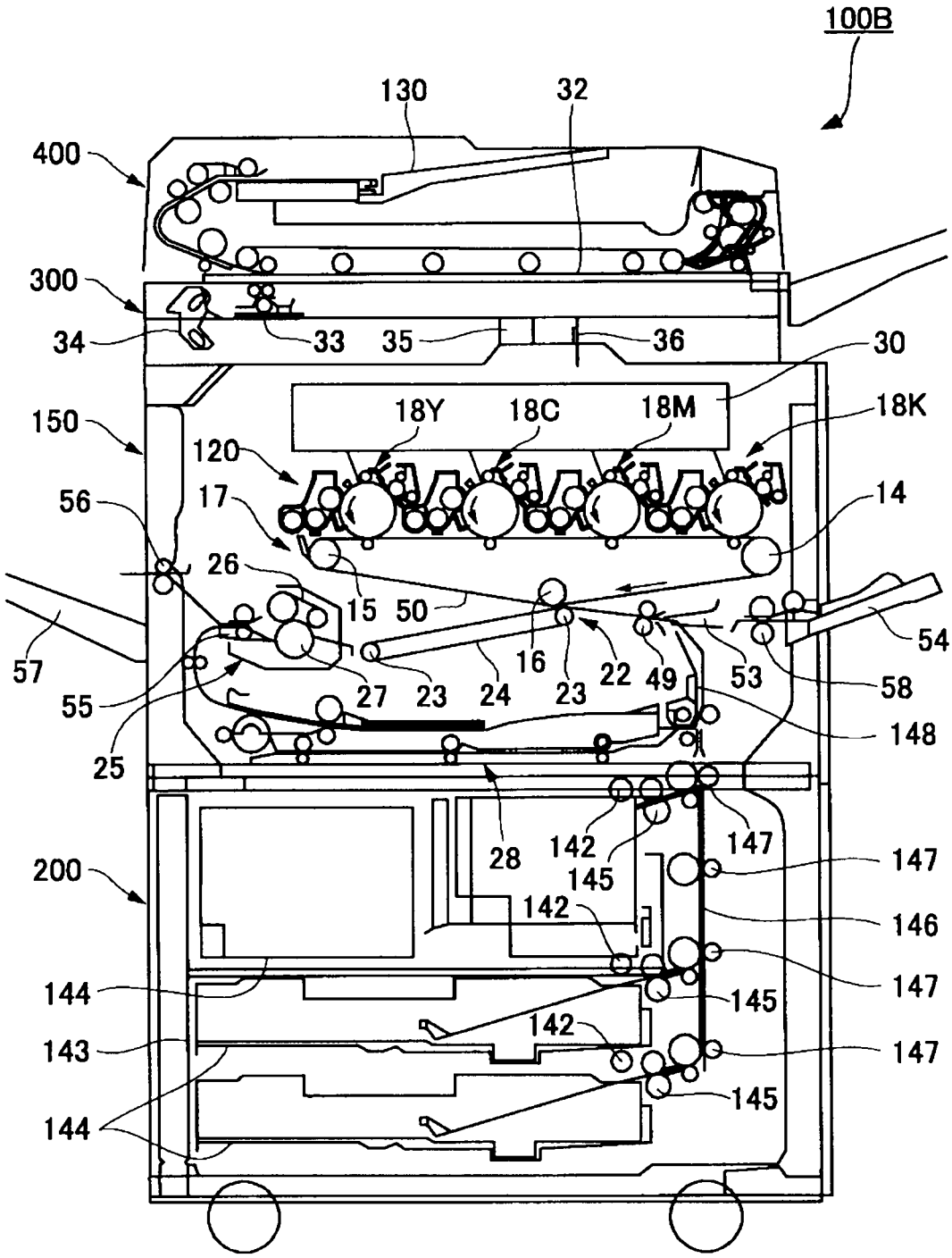
FIG. 2 shows another example of an image forming apparatus used in the present invention.

Another example of the image forming apparatus of the present invention is shown in FIG. 2. A tandem image forming apparatus 100B is a tandem color image forming apparatus. The tandem image forming apparatus contains a copying machine main body 150, a paper feeder table 200, a scanner 300, and an automatic document feeder (ADF) 400.

The copying machine main body 150 contains an endless-belt intermediate transfer medium 50 in the center. The intermediate transfer medium 50 is stretched around support rollers 14, 15, and 16 and is configured to rotate in an arrow direction.

Figure 3:
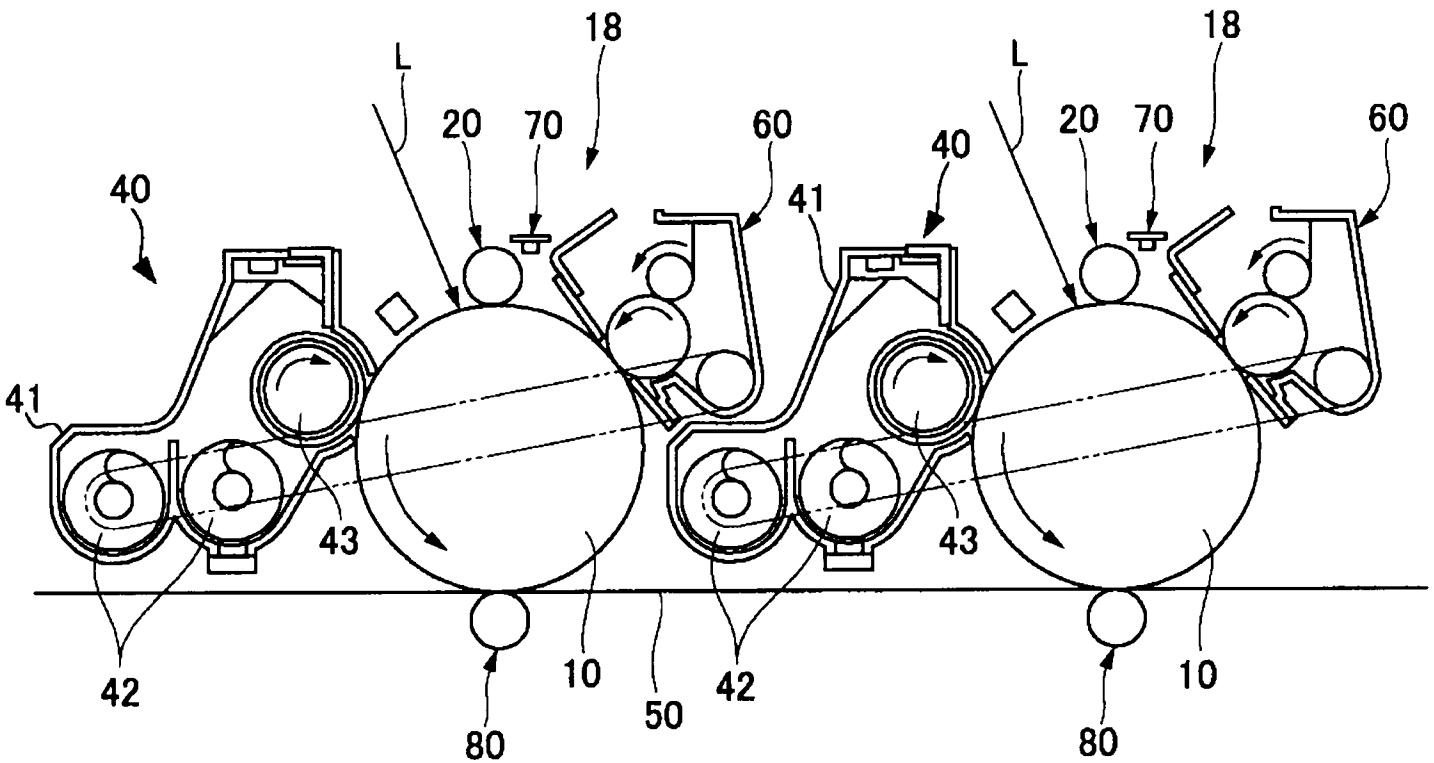
FIG. 3 shows a tandem developing unit in FIG. 2.

There is disposed a cleaning device 17 for removing residual toner on the intermediate transfer medium 50 adjacent to the support roller 15. Four image forming units 18 of yellow, cyan, magenta, and black are arrayed in parallel in a conveyance direction of the intermediate transfer medium 50, and face the intermediate transfer medium 50 stretched around the support rollers 14 and 15, to thereby constitute a tandem developing unit 120. Image forming units 18 for the respective colors shown in FIG. 3 contain photoconductors 10, charging rollers 20 configured to uniformly charge the photoconductors 10, developing devices 40 configured to develop the latent electrostatic images formed on the photoconductors 10 using respective developers of black (K), yellow (Y), magenta (M) and cyan (C) so as to form toner images, transfer rollers 80 configured to transfer the toner images of respective colors on the intermediate transfer media 50, cleaning devices 60 and charge-eliminating lamps 70.

An exposurer 30 is disposed adjacent to the tandem developing device 120. The exposurer 30 applies light L on the photoconductors 10 so as to form latent electrostatic images.

A secondary transferring unit 22 is disposed on the opposite side of the intermediate transfer medium 50 to where the tandem developing device 120 is disposed. The secondary transferring unit 22 consists of a secondary transfer belt 24 which is an endless belt stretched around a pair of rollers 23 and is configured so that the recording medium (transfer sheet) conveyed on the secondary transfer belt 24 contacts with the intermediate transfer medium 50.

Adjacent to the secondary transferring unit 22, there is disposed an image fixing device 25. The image fixing device 25 includes a fixing belt 26 which is an endless belt, and a pressurizing roller 27 which is disposed so as to contact against the fixing belt 26.

Additionally, a sheet reverser 28 is disposed adjacent to the secondary transferring unit 22 and the image fixing device 25. The sheet reverser 28 is configured to reverse a recording sheet so as to form images on both sides of the recording sheet.

Next, full color image formation (color copy) in an image forming apparatus 100B will be explained. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document. At the time of pushing a start switch (not shown), the document placed on the automatic document feeder 400 is transported onto the contact glass 32. When the document is initially placed on the contact glass 32, the scanner 300 is immediately driven to operate a first carriage 33 and a second carriage 34. Light is applied from a light source by means of the first carriage 33 to the document, and the reflected light is further reflected by a mirror of the second carriage 34 and passes through an image forming lens 35 into a read sensor 36 to thereby read the color document (color image). The read color image is interpreted to image information of black, yellow, magenta and cyan.

Moreover, each latent electrostatic image for each color is formed on each photoconductor 10 on the basis of the obtained image information for each color by the exposurer 30, and then the latent electrostatic image for each color is developed with a developer fed from each developing device 40 for each color so as to form a toner image for each color. The formed toner images for each color are sequentially transferred (primary transfer) on the intermediate transfer medium 50 which is rotated by support rollers 14, 15 and 16, thereby formed a composite toner image on the intermediate transfer medium 50.

One of paper feeding rollers 142 of the paper feeding table 200 is selectively rotated, sheets (recording sheets) are ejected from one of multiple paper feeding cassettes 144 in a paper bank 143 and are separated by a separation roller 145 one by one into a paper feeding path 146, are transported by a transport roller 147 into a paper feeding path 148 in the copying machine main body 150 and are bumped against a resist roller 49. Alternatively, one of the paper feeding rollers 142 is rotated to eject recording sheets from a manual-feeding tray 54, and the sheets are separated by a separation roller 58 one by one into a paper feeding path 53, transported one by one and then bumped against the resist roller 49. Note that, the resist roller 49 is generally grounded, but it may be biased for removing paper dust of the recording sheets.

The resist roller 49 is rotated synchronously with the movement of the composite toner image formed on the intermediate transfer medium 50 to transport the recording sheet into between the intermediate transfer medium 50 and the secondary transferring unit 22, and the composite toner image is transferred (secondarily transferred) onto the recording sheet.

The recording sheet on which the composite toner image has been transferred is transported by the secondary transferring unit 22 into an image fixing device 25. Then, the composite toner image is fixed on a recording medium by heating and pressing with a fixing belt 26 and pressurizing roller 27 in the fixing device 25. Thereafter, the recording sheet changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer position, subjected to an image formation on the back surface thereof, and then ejected by an ejecting roller 56 and is stacked on an output tray 57.

A residual toner on the intermediate transfer medium 50 after the composite toner image is transferred is cleaned by the cleaning device 17.

The process cartridge used in the present invention may be detachably mounted on a variety of image forming apparatuses. The process cartridge includes at least a latent electrostatic image bearing member for bearing a latent electrostatic image thereon and a developing unit for developing the latent electrostatic image on the latent electrostatic image bearing member using the developer of the present invention to form a toner image, and may further include other units as necessary.

The developing unit contains at least a developer container for storing the developer of the present invention and a developer carrier for carrying and transferring the developer stored in the developer container and may further contain a layer-thickness control member for controlling the thickness of carried developer layer.

Figure 4:
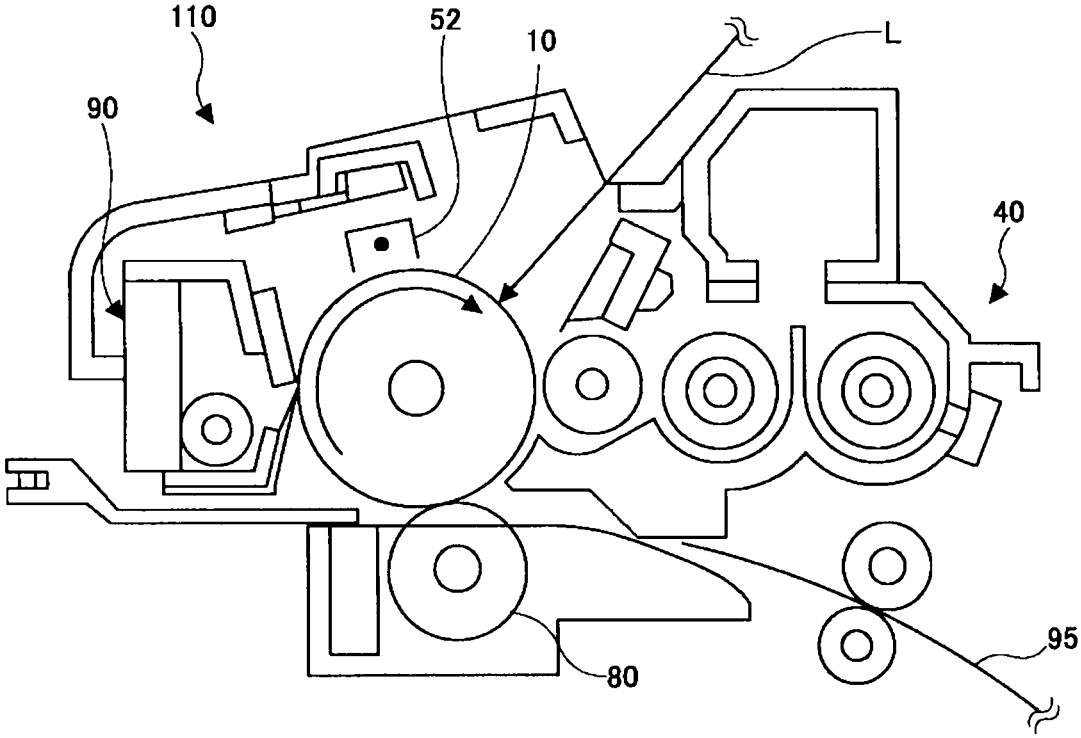
FIG. 4 shows an example of a process cartridge used in the present invention.

An example of the process cartridge used in the present invention is shown in FIG. 4. The process cartridge 110 includes a photoconductor 10, a corona charger 52, a developing device 40, a transfer roller 80 and a cleaning device 90.

EXAMPLES

Hereinafter, Examples of the present invention will be described, which however shall not be construed as limiting the scope of the present invention. All percentages and parts are by mass unless indicated otherwise.

(Synthesis of Polyester Resin A)

Into a reaction vessel equipped with a cooling pipe, a stirrer, and a nitrogen gas inlet tube, 67 parts of bisphenol A ethyleneoxide (2 mol) adduct, 84 parts of bisphenol A propionoxide (3 mol) adduct, 274 parts of terephthalic acid, and 2 parts of dibutyltin oxide were loaded and reacted for 8 hours at 230° C. under normal pressure, and then further reacted for 5 hours under a reduced pressure of 10 mmHg to 15 mmHg to synthesize a polyester resin A. The thus obtained polyester resin A had a number-average molecular weight (Mn) of 2,100, a weight-average molecular weight of 5,600, a glass transition temperature (Tg) of 55° C. and an acid value of 20 mg KOH/g.

(Synthesis of Styrene-Acrylic Copolymer)

Into a reaction vessel equipped with a cooling pipe, a stirrer, and a nitrogen gas inlet tube, 300 parts of acetic ether, 200 parts of styrene, 100 parts of acrylic monomer, and 5 parts of azobisisobutyronitrile were loaded and reacted for 6 hours at 60° C. under normal pressure in a nitrogen atmosphere. Next, 200 parts of methanol was added and stirred for 1 hour, a supernatant was removed and dried under a reduced pressure to synthesize a styrene-acrylic copolymer. The obtained styrene-acrylic copolymer had a weight-average molecular weight (Mw) of 16,000 and a glass transition temperature (Tg) of 57° C.

(Preparation of Masterbatch)

A thousand (1,000) parts of water, 540 parts of carbon black, Printex 35 (manufactured by Degussa; DBP oil absorption amount of 42 ml/100 g; pH 9.5), and 1,200 parts of the polyester resin A were mixed by means of a Henschel Mixer (manufactured by Mitsui Mining Co., Ltd.). The mixture was kneaded at 150° C. for 30 minutes by a two-roller mill, rolled and cooled, and then milled by a pulverizer (manufactured by Hosokawa micron Co., Ltd.), to thereby prepare a masterbatch.

(Preparation of Polyester Prepolymer Solution)

Into a reaction vessel equipped with a cooling pipe, a stirrer, and a nitrogen gas inlet tube, 682 parts of bisphenol A ethyleneoxide (2 mol) adduct, 81 parts of bisphenol A propyleneoxide (2 mol) adduct, 283 parts of terephthalic acid, and 22 parts of trimellitic anhydride and 2 parts of dibutyltin oxide were loaded and reacted for 8 hours at 230° C. under normal pressure. Subsequently, the reaction solution was reacted for 5 hours under a reduced pressure of 10 mmHg to 15 mmHg to synthesize an intermediate polyester resin. The thus obtained intermediate polyester resin had a number-average molecular weight (Mn) of 2,100, a weight-average molecular weight (Mw) of 9,600, a glass transition temperature (Tg) of 55° C., an acid value of 0.5 mg KOH/g and a hydroxyl group value of 49 mg KOH/g.

Next, into a reaction vessel equipped with a cooling pipe, a stirrer, and a nitrogen gas inlet tube, 411 parts of the intermediate polyester resin, 89 parts of isophorone diisocyanate and 500 parts of ethyl acetate were loaded and reacted for 5 hours at 100° C. to prepare a polyester prepolymer. The thus obtained polyester prepolymer had a solid content concentration of 50% (after leaving for 45 minutes at 150° C.) and a free isocyanate content of 1.60%.

(Synthesis of Ketimine)

Into a reaction vessel equipped with a stirring rod and a thermometer, 30 parts of isophoronediamine and 70 parts of methyl ethyl ketone were loaded, followed by reaction at 50° C. for 5 hours to thereby synthesize a ketimine compound.

The thus obtained ketimine compound had an amine value of 423 mg KOH/g.

(Synthesis of Modified Hydrocarbon Wax)

Into a reaction vessel equipped with a stirring rod and a thermometer, 100 parts of paraffin wax HNP-11 (NIPPON SEIRO CO., LTD.) were loaded and heated to 150° C. by a heater to melt the wax. Next, maleic anhydride and organic peroxide di-t-butylperoxide were dissolved in toluene to prepare a solution and the solution was dropped into the reaction vessel to be reacted for 5 hours under stirring. Then, toluene was removed under nitrogen purge to synthesize a modified paraffin wax A. The modified paraffin wax A had a melting point of 69° C., an acid value of 10 mg KOH/g and a melt viscosity of 10 mPa·s at 120° C.

At that stage, the amount of drop of the solution and reaction time were adjusted to synthesize modified hydrocarbon waxes (modified paraffin waxes A to H, modified polyethylene wax and modified polypropylene wax) having an acid value of 1 mg KOH/g to 105 mg KOH/g (see Table 1).

TABLE 1

| Releasing agent | Melting point [° C.] | Acid Value [mg KOH/g] | Melt viscosity at 120° C. [mPa · s] |
|---|---|---|---|
| Modified paraffin wax A | 69 | 10 | 10 |
| Modified paraffin wax B | 69 | 20 | 15 |

TABLE 1-continued

| Releasing agent | Melting point [° C.] | Acid Value [mg KOH/g] | Melt viscosity at 120° C. [mPa · s] |
|---|---|---|---|
| Modified paraffin wax C | 69 | 90 | 25 |
| Modified paraffin wax D | 69 | 105 | 30 |
| Modified paraffin wax E | 69 | 3 | 10 |
| Modified paraffin wax F | 69 | 1 | 10 |
| Modified paraffin wax G | 55 | 10 | 10 |
| Modified paraffin wax H | 90 | 10 | 20 |
| Modified polyethylene wax | 100 | 20 | 20 |
| Modified polypropylene wax | 120 | 20 | 40 |
| Paraffin wax | 69 | 0 | 10 |
| Carnauba wax | 85 | 20 | 45 |

WINTEC (by JAPAN polypropylene Corporation) having a melting point of 125° C. was used as polypropylene wax, and CERAFLOUR 991 (by byk chemie) having a melting point of 105° C. was used as polyethylene wax.

(Preparation of Aqueous Medium)

Three hundred six (306) parts of ion-exchanged water, 265 parts of 10% tricalcium phosphate suspension and 0.2 parts of sodium dodecyl benzene sulfonate were mixed and stirred to be uniformly dispersed to thereby prepare an aqueous medium.

Example 1

In a beaker, 10 parts of the polyester prepolymer solution, 75 parts of the polyester resin A and 130 parts of ethyl acetate were loaded and stirred to be dissolved. Next, 5 parts of the modified paraffin wax A and 10 parts of the masterbatch were added therein, and then the solution was prepared by using a bead mill, Ultra Visco Mill (manufactured by Aimex Co., Ltd.) with a condition of a solution feed rate of 1 kg/hr, disc circumferential velocity of 6 m/s, 0.5 mm zirconia beads packed to 80% by volume, and 3 passes. Subsequently, 2.7 parts of the ketimine compound was added and dissolved in the solution to prepare a toner material solution.

Subsequently, 150 parts of the aqueous medium was loaded in a vessel. While the aqueous medium was stirred at 12,000 rpm by using a TK homomixer (manufactured by Primix Corp.), 100 parts of the toner material solution was added therein and mixed for 10 minutes to prepare an emulsion slurry.

Next, 100 parts of the emulsion slurry was loaded into a flask equipped with a stirrer and a thermometer and the solvent was removed at 30° C. for 12 hours under stirring at a circumferential velocity of 20 m/min to prepare a dispersion slurry.

Subsequently, after 100 parts of the dispersion slurry was filtered under reduced pressure, 100 parts of ion-exchanged water was added to a filter cake and mixed at 12,000 rpm for 10 minutes by using a TK homomixer, and then filtered. To the obtained filter cake 300 parts of ion-exchanged water was added and mixed at 12,000 rpm for 10 minutes by using the TK homomixer, and then filtered twice. To the obtained filter cake 20 parts of 10% aqueous solution of sodium hydroxide was added and mixed at 12,000 rpm for 30 minutes by using the TK homomixer, and then filtered under a reduced pressure. To the obtained filter cake 300 parts of ion-exchanged water was added and mixed at 12,000 rpm for 10 minutes by using the TK homomixer, and then filtered. To the obtained filter cake 300 parts of ion-exchanged water was added and mixed at 12,000 rpm for 10 minutes by using the TK homomixer, and then filtered twice. To the obtained filter cake 20 parts of 10% hydrochloric acid was further added and mixed at a 12,000 rpm for 10 minutes by using the TK homomixer, and then filtered. Finally, 300 parts of ion-exchanged water was added to the obtained filter cake and mixed at 12,000 rpm for 10 minutes by using the TK homomixer, and then filtered twice to obtain a final filter cake.

The obtained filter cake was then dried by means of a circulating air dryer at 45° C. for 48 hours and passed through a 75 μm mesh sieve to obtain base particles. The properties of the obtained base particles are shown in Table 2.

TABLE 2

| | Amount of releasing agent [% by mass] | Dispersion diameter of releasing agent [μm] | Dv [μm] | Dv/Dn |
|---|---|---|---|---|
| Example 1 | 5.0 | 0.3 | 5.0 | 1.10 |
| Example 2 | 4.8 | 0.2 | 4.8 | 1.10 |
| Example 3 | 5.0 | 0.3 | 5.0 | 1.09 |
| Example 4 | 4.5 | 0.2 | 5.0 | 1.13 |
| Example 5 | 5.0 | 0.4 | 5.0 | 1.12 |
| Example 6 | 5.0 | 0.5 | 5.0 | 1.14 |
| Example 7 | 5.0 | 0.4 | 4.8 | 1.10 |
| Example 8 | 5.0 | 0.5 | 5.2 | 1.12 |
| Example 9 | 5.0 | 0.5 | 5.0 | 1.15 |
| Example 10 | 5.0 | 0.5 | 5.0 | 1.13 |
| Example 11 | 5.0 | 0.3 | 5.0 | 1.12 |
| Example 12 | 4.8 | 0.4 | 5.0 | 1.14 |
| Comparative Example 1 | 5.0 | 1.2 | 5.1 | 1.25 |
| Comparative Example 2 | 5.0 | 0.3 | 5.2 | 1.15 |
| Comparative Example 3 | 5.0 | 0.3 | 5.0 | 1.20 |

Example 2

Base particles were obtained in the same manner as in Example 1, except that the modified paraffin wax B was used instead of the modified paraffin wax A.

Example 3

Base particles were obtained in the same manner as in Example 1, except that the modified paraffin wax C was used instead of the modified paraffin wax A.

Example 4

Base particles were obtained in the same manner as in Example 1, except that the modified paraffin wax D was used instead of the modified paraffin wax A.

Example 5

Base particles were obtained in the same manner as in Example 1, except that the modified paraffin wax E was used instead of the modified paraffin wax A.

Example 6

Base particles were obtained in the same manner as in Example 1, except that the modified paraffin wax F was used instead of the modified paraffin wax A.

Example 7

Base particles were obtained in the same manner as in Example 1, except that the modified paraffin wax G was used instead of the modified paraffin wax A.

Example 8

Base particles were obtained in the same manner as in Example 1, except that the modified paraffin wax H was used instead of the modified paraffin wax A.

Example 9

Base particles were obtained in the same manner as in Example 1, except that the modified polyethylene wax was used instead of the modified paraffin wax A.

Example 10

Base particles were obtained in the same manner as in Example 1, except that the modified polypropylene wax was used instead of the modified paraffin wax A.

Example 11

Base particles were obtained in the same manner as in Example 1, except that methyl ethyl ketone was used instead of the ethyl acetate.

Example 12

A toner was produced by the dissolution/suspension method (emulsification/dispersion method) in accordance with Example 1 described in JP-A No. 11-52619.

After 1,243 parts of terephthalic acid, 1,830 parts of bisphenol A ethyleneoxide (2 mol) adduct and 840 parts of bisphenol A propyleneoxide (2 mol) adduct were mixed at 180° C. while heating, 3 parts of dibutyltinoxide was added and then water was removed while heating at 220° C. to obtain a polyester resin. To this polyester resin 1,500 parts of cyclohexanone was added and dissolved, and 250 parts of acetic anhydride was added and heat at 130° C. Next, a solvent and unreacted acid were removed by heating under reduced pressure to prepare a polyester resin B. The obtained polyester resin B had a glass transition temperature (Tg) of 60° C., an acid value of 3 mg KOH/g, and a hydroxyl value of 1 mg KOH/g.

Subsequently, 100 parts of the polyester resin B and 4 parts of C.I. pigment blue 15:3, 5 parts of the modified paraffin wax A and 110 parts of ethyl acetate were dispersed for 48 hours using a ball mill to prepare a toner material solution.

In a vessel 150 parts of an aqueous medium was loaded, 100 parts of the toner material solution was added while the aqueous medium was stirred at 12,000 rpm by using a TK homomixer (manufactured by Tokushu Kika Chemical Co., Ltd), and then mixed for 10 minutes to prepare an emulsified slurry. Furthermore, the solvent was removed under reduced pressure, and then washed and dried to obtain base particles.

Comparative Example 1

Base particles were obtained in the same manner as in Example 1, except that paraffin wax was used instead of the modified paraffin wax A.

Comparative Example 2

Base particles were obtained in the same manner as in Example 1, except that carnauba wax was used instead of the modified paraffin wax A.

Comparative Example 3

Base particles were obtained in the same manner as in Example 1, except that styrene acryl copolymer was used instead of the polyester resin A.

(Preparation of Toner)

Using a HENSCHEL MIXER (manufactured by Mitsuikozan Co., Ltd), as an external additive 1.0 part of hydrophobic silica, H2000 (manufactured by Clariant Japan) was mixed with 100 parts of the base particles. Upon mixing, 5 cycles of 30-second mixing at a circumferential rate of 30 m/s followed by 1 min-pausing were carried out, and the resulting mixture was passed through a 35 μm mesh sieve to prepare a toner.

(Preparation of Carrier)

To 100 parts of toluene, 100 parts of a silicone resin (organostraight silicone), 5 parts of γ-(2-amino ethyl)aminopropyltrimethoxysilane, and 10 parts of carbon black were added, and dispersed for 20 minutes by using a homomixer to prepare a coating solution for a resin layer. Using a fluid bed type coater, the coating solution for resin layer was applied over the surface of spherical magnetite particles (1,000 parts) having an average particle diameter of 50 μm to prepare a carrier.

(Preparation of Developer)

Five (5) parts of the toner and 95 parts of the carrier were mixed in a ball mill to prepare a developer.

(Evaluation Method and Evaluation Result)

The obtained developer was evaluated as follows. The evaluation results are shown in Table 3.

<Lowest Fixing Temperature>

A photocopier, MF-200 (manufactured by Ricoh Company, Ltd.) in which a fixing unit thereof had been modified by using a TEFRON roller as a fixing roller, and a transfer paper Type 6200 (manufactured by Ricoh Company, Ltd.) were used to carry out a photocopying test in which the temperature of the fixing roller was changed at 5° C. intervals. The minimum fixing temperature was defined as the lowest temperature of the fixing roller when a residual ratio of an image density was 70% or more after a fixed image was rubbed with a pad. The lowest temperature was preferably as low as possible, because electrical power consumption is suppressed. The temperature of 135° C. or less was an allowable level for practical use.

<Hot Offset Occurrence Temperature>

From a fixing unit of a tandem color electrophotographic apparatus Imagio Neo C350 (by Ricoh Company, Ltd.), the silicone oil coating mechanism was removed to employ an oil-less fixing system, and then the apparatus was tuned to be able to adjust temperature and linear velocity. The tandem color electrophotographic apparatus was adjusted to develop an image by using a toner in an amount of 0.85 mg/cm$^2$±0.3 mg/cm$^2$. The obtained image was fixed by changing the temperature of the fixing roller at 5° C. intervals to measure the fixing temperature at which hot offset occurred, i.e., hot offset occurrence temperature, and the maximum temperature of the fixing roller capable of fixing an image without occurring hot offset was determined as the highest fixing temperature. As latitude for offset resistance was increased, the highest fixing temperature was preferably as high as possible, and 190° C. or more was an allowable level for practical use.

<Transfer Rate>

Using an image forming apparatus MF2800 (manufactured by Ricoh Company, Ltd.), a solid black image of 15 cm×15 cm having an average image density of 1.38 or more mea sured by MacBeth reflective densitometer was formed and a transfer rate was determined by the following equation:

Transfer rate [%]=(an amount of toner transferred on a recording medium/an amount of toner developed on a photoconductor)×100

The transfer rate was evaluated on the basis of the following evaluation criteria:

A: Transfer rate was 90% or more

B: Transfer rate was 80% to less than 90%

C: Transfer rate was 70% to less than 80%

D: Transfer rate was less than 70%<

<Uneven Transfer>

Using an image forming apparatus MF2800 (manufactured by Ricoh Company, Ltd.), a solid black image was formed, and the obtained image was visually observed to check whether an uneven transfer was present or not and evaluated on the basis of the following evaluation criteria:

A: No uneven transfer was observed and it was an excellent image.

B: No uneven transfer was observed and there was no problem on practical use.

C: Some uneven transfers were observed but on a practical level.

D: Uneven transfers were observed and there was a problem for practical use.

adhesion of toner components, mainly a releasing agent to the photoconductor on the basis of the following evaluation criteria:

A: No adhesion of the toner component to the photoconductor

B: Adhesion of the toner component to the photoconductor was observed, but on a practical level.

C: Adhesion of the toner component to the photoconductor was observed, and there was a problem for practical use.

Moreover, the following evaluation was conducted using the obtained toner. The results are shown in Table 3.

<Heat Resistance and Storage Stability>

Each of the obtained toners was loaded into a 50 ml glass container, and allowed to stand at 50° C. in a constant temperature bath for 24 hours, and then the toner was cooled to 24° C., and the penetration was measured (expressed in millimeter) in accordance with a penetration test (JIS K2235-1991) to evaluate heat resistance and storage stability based on the following criteria. The higher value of penetration meant more excellent in heat resistance and storage stability, and the penetration of less than 5 mm had a higher possibility of occurrence of problems during usage.

A: Penetration was 25 mm or greater

B: Penetration was 15 mm to less than 25 mm

C: Penetration was 5 mm to less than 15 mm

D: Penetration was less than 5 mm

TABLE 3

| | Fixing properties | | Transfer properties | | Heat resistance | | |
|---|---|---|---|---|---|---|---|
| | Lowest fixing temperature [° C.] | Hot offset occurrence temperature [° C.] | Transfer rate | Uneven transfer | and storage stability | Fogging | Filming |
| Example 1 | 130 | 210 | A | A | B | A | A |
| Example 2 | 130 | 205 | A | A | B | A | A |
| Example 3 | 130 | 200 | A | A | B | A | A |
| Example 4 | 135 | 190 | A | A | B | A | A |
| Example 5 | 130 | 210 | B | B | B | A | A |
| Example 6 | 130 | 210 | B | B | B | A | A |
| Example 7 | 130 | 210 | B | B | B | A | A |
| Example 8 | 135 | 200 | A | A | A | A | A |
| Example 9 | 135 | 200 | A | A | A | A | A |
| Example10 | 140 | 200 | A | A | A | A | A |
| Example11 | 130 | 210 | A | A | B | A | A |
| Example12 | 140 | 195 | B | B | B | A | A |
| Comparative Example 1 | 130 | 200 | D | D | B | B | C |
| Comparative Example 2 | 140 | 180 | B | B | B | A | B |
| Comparative Example 3 | 150 | 190 | C | C | B | A | B |

<Fogging>

Using a tandem color electrophotographic apparatus Imagio Neo 450 (manufactured by Ricoh Company, Ltd.), having a cleaning blade and charging roller contacting with a photoconductor, 10,000 sheets of A4 widthwise chart (an image pattern A), in which black solids and white solids were repeated at 1 cm intervals in a direction perpendicular to a rotational direction of a developing sleeve, were printed, and subsequently a blank image was printed and then visually observed on fogging and evaluated on the basis of the following evaluation criteria:

A: No fogging

B: With fogging

<Filming>

Using an image forming apparatus MF2800 (manufactured by Ricoh Company, Ltd.) 10,000 sheets of image were formed on a photoconductor, and then the photoconductor was visually checked and evaluated on the occurrence of As is clear from Table 3, the toners of Examples were excellent in fixing property, and heat resistance and storage stability, because each of the toners of Examples contained the polyester resin having excellent fixing property and as the releasing agent in the toner containing the polyester resin the hydrocarbon wax having excellent releasing property and modified with maleic anhydride. Moreover, because the releasing agent was uniformly dispersed in each of the base particles with maintaining offset resistance, the base particles had uniform flowability and charge property, thereby reducing the amount of wax exposed on the surface of the base particles. Thus, it was confirmed that the transfer rate, fogging, filming and the like could be improved, and high quality image could be formed for a long period using the toner of the present invention.

In Examples 1 to 6, each of the toners was prepared by using the modified paraffin wax in which the acid value was adjusted. In Examples 1, 2 and 5, each of the modified paraffin waxes had an acid value of 3 mg KOH/g to 20 mg KOH/g, thereby obtaining a toner having excellent releasing property and sharp particle size distribution. As a result, a high quality image having excellent transfer property could be obtained without occurrence of fogging and filming for a long period. The acid value of each of the releasing agents in the toners of Examples 3 and 4 was relatively larger than that of Example 1, thus, a high quality image could be obtained with maintaining sufficient releasing property using the toners of Examples 3 and 4, although the toners were inferior in releasing property to that of Example 1. In Example 6, a high quality image having excellent transfer property could be obtained without occurrence of fogging and filming for a long period, although the toner of Example 6 contained a releasing agent having a relatively small acid value and the particle size distribution was broader than that of Example 1.

In Example 7, the releasing agent of Example 7 had a lower melting point than that of Example 1, thereby obtaining a high quality image without occurrence of fogging and filming for a long period, although the toner of Example 7 had inferior in transfer property to that of Example 1. The releasing agents in the toners of Examples 8 to 10 had relatively higher melting point than that of Example 1, thus the toners of Examples 8 to 10 had inferior in low-temperature fixing property to that of Example 1, but sufficient low-temperature fixing property could be obtained.

In Example 11, the organic solvent in the toner material solution was changed to methyl ethyl ketone, but still a high quality image having excellent low-temperature fixing property, releasing property and transfer property could be obtained without occurrence of fogging and filming for a long period.

The toner of Example 12 was relatively inferior in releasing property and low-temperature fixing property to that of Example 1, because the modified polyester resin was used alone. However, in Example 12, sufficient fixing property and a high quality image having excellent transfer property could be obtained without occurrence of fogging and filming for a long period.

On the other hand, the toner of Comparative Example 1 containing hydrocarbon wax was excellent in fixing property, particularly, offset resistance, but wax was not sufficiently dispersed. Therefore, the amount of the wax was not uniformly contained in each of the base particles, causing a wide particle size distribution of the base particles. As a result, the transfer property, fogging and filming were adversely affected.

The toner of Comparative Example 2 contained carnauba wax. There was no serious problem in transfer property, fogging and filming, but releasing property was not sufficient. Thus, offset resistance was poor.

The toner of Comparative Example 3 contained the styrene-acrylic copolymer instead of the polyester resin. Thus, low-temperature fixing property was poor.

Thus, the toner of the present invention can be used in low-temperature fixing system and has excellent offset resistance, and a fixing device and images are not easily contaminated by the toner. Moreover, the toner of the present invention has a narrow particle size distribution and a small particle diameter, and can form a toner image having a sharp charge amount distribution and excellent sharpness for a long period.

What is claimed is:

1. A toner comprising:

base particles produced by dissolving and/or dispersing a toner material in an organic solvent so as to prepare a toner material solution, and emulsifying and/or dispersing the toner material solution in an aqueous medium, wherein the toner material comprises a binder resin and a releasing agent, the binder resin comprises a polyester resin, and the releasing agent consists of a hydrocarbon wax which is modified with a carboxylic acid or carboxylic anhydride, and wherein the releasing agent has a dispersion diameter of 0.05 μm to 0.5 μm, an acid value of 1 mg KOH/g to 100 mg KOH/g and a melting point of 50° C. to 90° C.

2. The toner according to claim 1, wherein the releasing agent has an acid value of 3 mg KOH/g to 20 mg KOH/g.

3. The toner according to claim 1, wherein the polyester resin has an acid value of 5 mg KOH/g to 40 mg KOH/g.

4. The toner according to claim 1, wherein the releasing agent consists of a paraffin wax modified with a carboxylic acid or carboxylic anhydride.

5. The toner according to claim 1, wherein the carboxylic anhydride is maleic anhydride.

6. The toner according to claim 1, wherein the releasing agent has a melt viscosity at 120° C. of 1.0 mPa·s to 20 mPa·s.

7. The toner according to claim 1, wherein the base particles have a volume average particle diameter of 3.0 μm to less than 6.0 μm.

8. The toner according to claim 1, wherein the base particles have a ratio of a volume average particle diameter to a number average particle diameter of 1.00 to 1.15.

9. The toner according to claim 1, wherein the mass ratio of the releasing agent relative to the base particles is 1% to 20%.

10. The toner according to claim 1, wherein the binder resin further comprises a polyester resin having a functional group reactive with an active hydrogen group, and wherein the polyester resin having a functional group reactive with an active hydrogen group and an active hydrogen group-containing compound are reacted in the aqueous medium.

11. A method for producing a toner according to claim 1, comprising:

dissolving and/or dispersing the toner material in an organic solvent so as to prepare a toner material solution; and emulsifying and/or dispersing the toner material solution in an aqueous medium so as to prepare the base particles.

12. The method for producing a toner according to claim 11, wherein the organic solvent has a solubility parameter of 8 $cal^{1/2}\cdot m^{-3/2}$ to 9.8 $cal^{1/2}\cdot m^{3/2}$.

13. The method for producing a toner according to claim 11, wherein the step of dissolving and/or dispersing the toner material in the organic solvent so as to prepare the toner material solution comprises:

heating and dissolving the binder resin and the releasing agent in the organic solvent so as to prepare a solution in which the binder resin and the releasing agent are dissolved; and cooling the solution.

14. A developer comprising:

a toner, wherein the toner comprises base particles produced by dissolving and/or dispersing a toner material in an organic solvent so as to prepare a toner material solution, and emulsifying and/or dispersing the toner material solution in an aqueous medium, and wherein the toner material comprises a binder resin and a releasing agent, the binder resin comprises a polyester resin, and the releasing agent consists of a hydrocarbon wax which is modified with a carboxylic acid or carboxylic anhydride, and wherein the releasing agent has a dispersion diameter of 0.05 μm to 0.5 μm, an acid value of 1 mg KOH/g to 100 mg KOH/g and a melting point of 50° C. to 90° C.

15. The developer according to claim 14, further comprising a carrier.

* * * * *